US011193256B2

(12) United States Patent
Guimaraes et al.

(10) Patent No.: US 11,193,256 B2
(45) Date of Patent: Dec. 7, 2021

(54) LOCK ASSEMBLY FOR AN EXCAVATOR WEAR MEMBER

(71) Applicant: CQMS PTY LTD, Mackay (AU)

(72) Inventors: Miguel Guimaraes, Mackay (AU); Bruce Lilley, Mackay (AU); Quintin Nienaber, Mackay (AU); Tony Young, Mackay (AU)

(73) Assignee: CQMS PTY LTD

( * ) Notice: Subject to any disclaimer, the term of this patent is extended or adjusted under 35 U.S.C. 154(b) by 0 days.

(21) Appl. No.: 16/503,158

(22) Filed: Jul. 3, 2019

(65) Prior Publication Data

US 2019/0323208 A1 Oct. 24, 2019

Related U.S. Application Data

(62) Division of application No. 13/497,989, filed as application No. PCT/AU2010/001556 on Nov. 19, 2010, now Pat. No. 10,385,548.

(30) Foreign Application Priority Data

Dec. 11, 2009 (AU) ..... 2009906064

(51) Int. Cl.
*E02F 9/28* (2006.01)
*E02F 3/32* (2006.01)

(52) U.S. Cl.
CPC ..... *E02F 9/2833* (2013.01); *E02F 9/2816* (2013.01); *E02F 9/2825* (2013.01); *E02F 3/32* (2013.01)

(58) Field of Classification Search
CPC ..... E02F 9/2833; E02F 9/2816; E02F 9/2825
See application file for complete search history.

(56) References Cited

U.S. PATENT DOCUMENTS

| | | | | |
|---|---|---|---|---|
| 2,124,912 A | | 7/1938 | Ehmann | |
| 2,373,722 A | | 4/1945 | Von Opel Fritz | |
| 2,688,894 A | | 9/1954 | Modrey | |
| 3,774,324 A | | 11/1973 | Lafond | |
| 3,839,805 A | | 10/1974 | Stepe | |
| 3,952,433 A | * | 4/1976 | Heinold | E02F 9/2841 37/457 |

(Continued)

FOREIGN PATENT DOCUMENTS

| | | |
|---|---|---|
| AU | 2003264586 | 7/2004 |
| AU | 2005203574 B2 | 3/2007 |

(Continued)

OTHER PUBLICATIONS

U.S. Appl. No. 13/497,989, filed Mar. 23, 2012.
U.S. Appl. No. 13/497,892, filed Jun. 28, 2012.

*Primary Examiner* — Thomas B Will
*Assistant Examiner* — Joan D Misa
(74) *Attorney, Agent, or Firm* — Leydig, Voit & Mayer Ltd.; John Augustyn

(57) ABSTRACT

A lock assembly for an excavator wear assembly, the lock assembly a locking pin having at least one dowel extending outwardly therefrom. The lock assembly also includes a retaining member having a seat and a cavity and a biasing member located within the cavity of the retaining member. The biasing member is adapted to exert a biasing force on the dowel to releasably retain the dowel within the seat of the retaining member.

15 Claims, 41 Drawing Sheets

(56) References Cited

U.S. PATENT DOCUMENTS 3,982,339 A 9/1976 Nilsson
4,182,058 A 1/1980 Poncin
4,231,173 A 11/1980 Davis
4,233,761 A 11/1980 Ryerson
4,338,736 A 7/1982 Radigan
4,404,760 A 9/1983 Hahn et al.
4,481,728 A 11/1984 Mulder et al.
4,516,340 A * 5/1985 Launder ..... E02F 9/2841 172/713
4,587,751 A * 5/1986 Sjogren ..... E02F 9/2841 172/753
4,716,668 A 1/1988 Hahn
4,823,486 A * 4/1989 Diekevers ..... E02F 9/2841 37/456
4,903,420 A 2/1990 Kreitzberg et al.
4,918,843 A * 4/1990 Kiesewetter ..... E02F 9/2841 267/141
4,932,478 A * 6/1990 Jones ..... A01B 15/025 172/699
5,009,017 A * 4/1991 Diekevers ..... E02F 9/2841 37/456
5,088,214 A 2/1992 Jones
5,172,501 A 12/1992 Pippins
5,205,057 A 4/1993 Garman
5,272,824 A 12/1993 Cornelius
5,337,495 A 8/1994 Pippins
5,386,653 A * 2/1995 Cornelius ..... E02F 9/2825 37/446
5,423,138 A * 6/1995 Livesay ..... E02F 9/2825 172/713
5,469,648 A 11/1995 Jones et al.
5,653,048 A 8/1997 Jones et al.
5,709,043 A 1/1998 Jones et al.
5,718,070 A 2/1998 Ruvang
5,765,301 A 6/1998 Clendenning
5,918,391 A 7/1999 Peya
5,937,550 A 8/1999 Emrich
5,937,551 A * 8/1999 Moehnke ..... E02F 3/58 37/456
5,956,874 A * 9/1999 Ianello ..... E02F 9/2833 172/772.5
5,987,787 A * 11/1999 Mack ..... E02F 9/2825 172/713
6,018,896 A 2/2000 Adamic
6,052,927 A 4/2000 Pippins
6,092,958 A * 7/2000 Gale ..... E02F 9/2833 37/456
6,108,950 A 8/2000 Ruvang et al.
6,119,378 A 9/2000 Pippins
6,439,796 B1 8/2002 Ruvang et al.
6,467,203 B2 * 10/2002 Pippins ..... E02F 9/2833 37/452
6,467,204 B1 10/2002 Creighton et al.
6,477,796 B1 * 11/2002 Cornelius ..... E02F 9/2825 37/452
6,708,431 B2 3/2004 Robinson et al.
6,735,890 B2 * 5/2004 Carpenter ..... E02F 9/2841 37/456
6,799,387 B2 10/2004 Pippins
6,826,855 B2 12/2004 Ruvang
6,959,506 B2 11/2005 Adamic et al.
7,069,676 B2 7/2006 Robinson et al.
7,100,315 B2 9/2006 Carpenter et al.
7,121,023 B2 10/2006 Robinson et al.
7,162,818 B2 1/2007 Ruvang et al.
7,178,274 B2 2/2007 Emrich
7,448,823 B2 11/2008 Silva
7,707,755 B2 5/2010 Lopez Almendros et al.
7,762,015 B2 * 7/2010 Smith ..... E02F 9/2825 37/455
7,788,830 B2 9/2010 Woerman et al.
8,468,724 B2 6/2013 Leslie et al.
8,776,408 B2 7/2014 Stewart
8,845,227 B2 9/2014 Colombo
8,904,677 B2 12/2014 Cui
8,931,190 B2 * 1/2015 Knight ..... E02F 9/2825 37/455
8,997,384 B2 * 4/2015 Bartolome Rodriguez ..... E02F 9/2833 37/456
9,009,995 B2 * 4/2015 Freund ..... E02F 9/2825 37/452
9,062,436 B2 * 6/2015 Renski ..... E02F 9/2833
9,139,984 B2 * 9/2015 Chenoweth ..... E02F 9/2841
9,163,378 B2 10/2015 Doan
2002/0000053 A1 * 1/2002 Adamic ..... E02F 9/2833 37/456
2003/0070330 A1 4/2003 Olds et al.
2003/0101627 A1 * 6/2003 Robinson ..... E02F 9/2825 37/456
2003/0140531 A1 * 7/2003 Pippins ..... E02F 9/2841 37/456
2004/0016153 A1 1/2004 Pippins
2004/0139632 A1 7/2004 Robinson et al.
2004/0237354 A1 * 12/2004 Emrich ..... E02F 9/2841 37/450
2007/0209189 A1 * 9/2007 Lopez Almendros ..... E02F 9/2841 29/525.01
2007/0256335 A1 11/2007 De Martiis
2009/0199442 A1 * 8/2009 Woerman ..... E02F 9/2825 37/457
2010/0115804 A1 * 5/2010 Lopez Almendros ..... E02F 9/2841 37/456
2010/0236108 A1 9/2010 Ruvang
2012/0055052 A1 3/2012 Campomanes et al.
2012/0260540 A1 * 10/2012 Guimaraes ..... E02F 9/2825 37/453
2013/0333254 A1 * 12/2013 Wallis ..... E02F 9/2825 37/456
2014/0245645 A1 9/2014 Marchand
2014/0331529 A1 * 11/2014 Guimaraes ..... E02F 9/2833 37/456

FOREIGN PATENT DOCUMENTS

AU 2009238226 B2 10/2009
CA 2161505 4/1997
CN 101535574 B 9/2009
WO WO 2004/027272 A2 4/2004
WO WO 2008/021376 A2 2/2008
WO WO 2008/116942 A1 10/2008
WO WO 2009/127016 A1 10/2009

* cited by examiner

LOCK ASSEMBLY FOR AN EXCAVATOR WEAR MEMBER

CROSS-REFERENCE TO RELATED APPLICATIONS

This patent application is a divisional of copending U.S. patent application Ser. No. 13/497,989, filed Jun. 28, 2012, which is incorporated by reference.

FIELD OF THE INVENTION

The invention relates to a lock assembly for an excavator wear member. In particular, although not exclusively, the invention relates to a lock assembly for releasably securing an excavator tooth to a nose of an excavator.

BACKGROUND TO THE INVENTION

Excavator tooth assemblies mounted to the digging edge of excavator buckets and the like generally comprise a replaceable digging tooth, an adaptor body and an adaptor nose which is secured by welding or the like to the digging edge of a bucket or the like. The tooth generally has a socket-like recess at its rear end to receivably locate a front spigot portion of the adaptor nose and a removable locking pin is generally employed to releasably secure the tooth on the adaptor.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of a wear member to a nose of an excavator, most of these proposals suffer from one or more deficiencies. As described hereinafter, many of the prior art references relate to direct mounting of a tooth onto a nose without an intermediate adaptor but in those assemblies, the mounting systems for securing teeth directly onto excavator noses is considered analogous to the mounting of a tooth onto an adaptor.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No US 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. Nos. 5,172,501 and 6,052,927.

Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No 2003264586 describes a locking pin assembly comprising a body member having a non-circular cross-sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

While generally satisfactory for their intended purpose, the abovementioned prior art all suffer from one or more shortcomings or disadvantages in terms of inadequate resistance to rotation of a tooth off a nose or an adaptor under the influence of vertical loads applying a rotational moment to the tooth, a predisposition to premature wear, difficulties in retention of the teeth on noses or adaptors, inadequate locking systems and unduly complicated configurations giving rise to increased fabrication costs. Furthermore, the prior art all generally rely on lock assemblies that require threaded components. Thread components in lock assemblies are generally disadvantageous as dirt and fines can infiltrate the threaded assembly thereby causing cementation and resulting in difficulties in removal.

OBJECT OF THE INVENTION

It is an object of the invention to overcome or at least alleviate one or more of the above problems and/or provide the consumer with a useful or commercial choice.

DISCLOSURE OF THE INVENTION

In one form, although it need not be the only or indeed the broadest form, the invention resides in a lock assembly for an excavator wear assembly, the lock assembly comprising:

a locking pin having at least one dowel extending outwardly therefrom;

a retaining member having a seat and a cavity; and a biasing member located within the cavity of the retaining member;

wherein the biasing member is adapted to exert a biasing force on the dowel to releasably retain the dowel within the seat of the retaining member.

Preferably, the retaining member has a ramp extending from within the cavity of the retaining member and terminating outwardly of an exterior surface of the retaining member.

Suitably, a detent extends outwardly from a body of the retaining member.

Preferably, at least one slot is located through an exterior surface of the retaining member.

Suitably, the at least one slot is adapted to receive the dowel of the locking pin.

Suitably, the biasing member is releasably secured within the cavity of the retaining member.

Preferably, wherein the seat is formed on an underside of an exterior surface of the retaining member.

Preferably, the seat is axially offset from a slot formed in an exterior surface of the retaining member.

Preferably, a passage is formed between an upper face of the biasing member and an underside of an exterior surface of the retaining member.

Suitably, the seat forms part of the passage.

In a preferred form, a land forms part of the passage such that the distance between the land and the upper face of the biasing member is smaller than a cross sectional dimension of the dowel.

Optionally, an angled guide surface forms part of the passage, the angled guide surface extending from a slot formed in an exterior surface of the retaining member towards the seat.

Suitably, the passage is adapted to receive the dowel when the locking pin is axially rotated such that the dowel is forced against a surface of the biasing member within the passage prior to location of the dowel within the seat.

In a further form, the invention resides in an excavator wear member comprising:

a locking aperture extending through a side wall of the excavator wear member, the locking aperture having a receiving passage and a retaining recess;

wherein, the receiving passage extends inwardly from an outer face of the side wall and the retaining recess is located on an inner face of mounting ear such that the receiving passage terminates at retaining recess.

Preferably, the excavator wear member further comprises a body and a mounting ear extending rearwardly of the body, the locking aperture extending through the mounting ear.

Suitably, a locking face is located at an inner end of the retaining recess.

Optionally, a pair of slots extend outwardly from diametrically opposed sides of the receiving passage.

Optionally, a ramp extends about an inner face of receiving passage.

Suitably, the ramp commences adjacent an outer end of the receiving passage and extends circumferentially about an inner face of receiving passage to terminate adjacent the retaining recess.

Conveniently, two ramps extend about an inner face of the receiving passage from diametrically opposing sides thereof.

Preferably, a blind slot extends outwardly of a main portion of the retaining recess.

In a preferred form, the receiving passage has a generally circular main portion and the retaining recess has a generally circular main portion, wherein the generally circular main portion of the receiving passage is concentric with the generally circular main portion of the retaining recess.

Suitably, the generally circular main portion of the retaining recess has a larger diameter than the generally circular main portion of the receiving recess.

In still a further form, the invention resides in an excavator wear assembly comprising:

an excavator wear member having a socket cavity and locking aperture extending through a side wall of the excavator wear member, the locking aperture having a receiving passage and a retaining recess;

a locking pin having at least one dowel extending outwardly therefrom;

a retaining member located within the retaining recess of the locking aperture, the retaining member having a seat and a cavity;

a biasing member located within the cavity of the retaining member; and an adaptor having a spigot portion located within the socket cavity of the excavator wear member and a retaining passage;

wherein the locking pin is located through the locking aperture of the excavator wear member and the retaining passage of the adaptor and wherein the biasing member is adapted to exert a biasing force on the dowel of the locking pin to retain the dowel within the seat of the retaining member to thereby releasably retain the spigot portion of the adaptor within the socket cavity of the excavator wear member.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

The excavator wear assembly and lock assembly therefore are described with reference to an excavator wear member in the form of a tooth releasably secured to an adaptor. The adaptor is in turn secured to a nose of an excavator bucket or the like. A skilled addressee will appreciate that the invention may be employed to releasably secure an adaptor to a nose or a tooth directly to a nose of an excavator bucket lip.

Furthermore, the lock assembly may be utilized in other applications such as a retaining pin for components in dragline excavator rigging and the like.

Figure 1A:
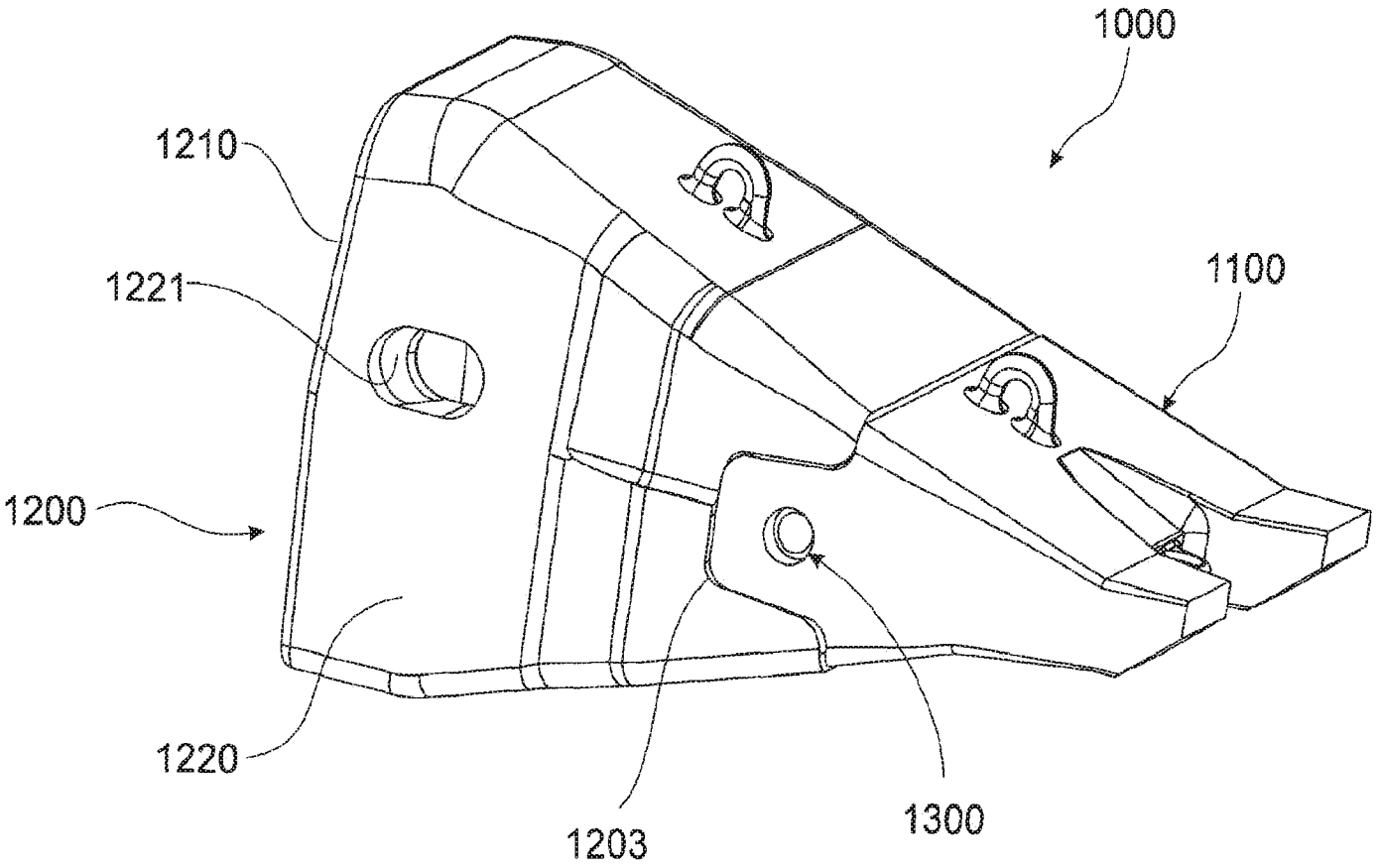
FIG. 1A shows a perspective view of an excavator wear assembly according to an embodiment of the invention.
Figure 1B:
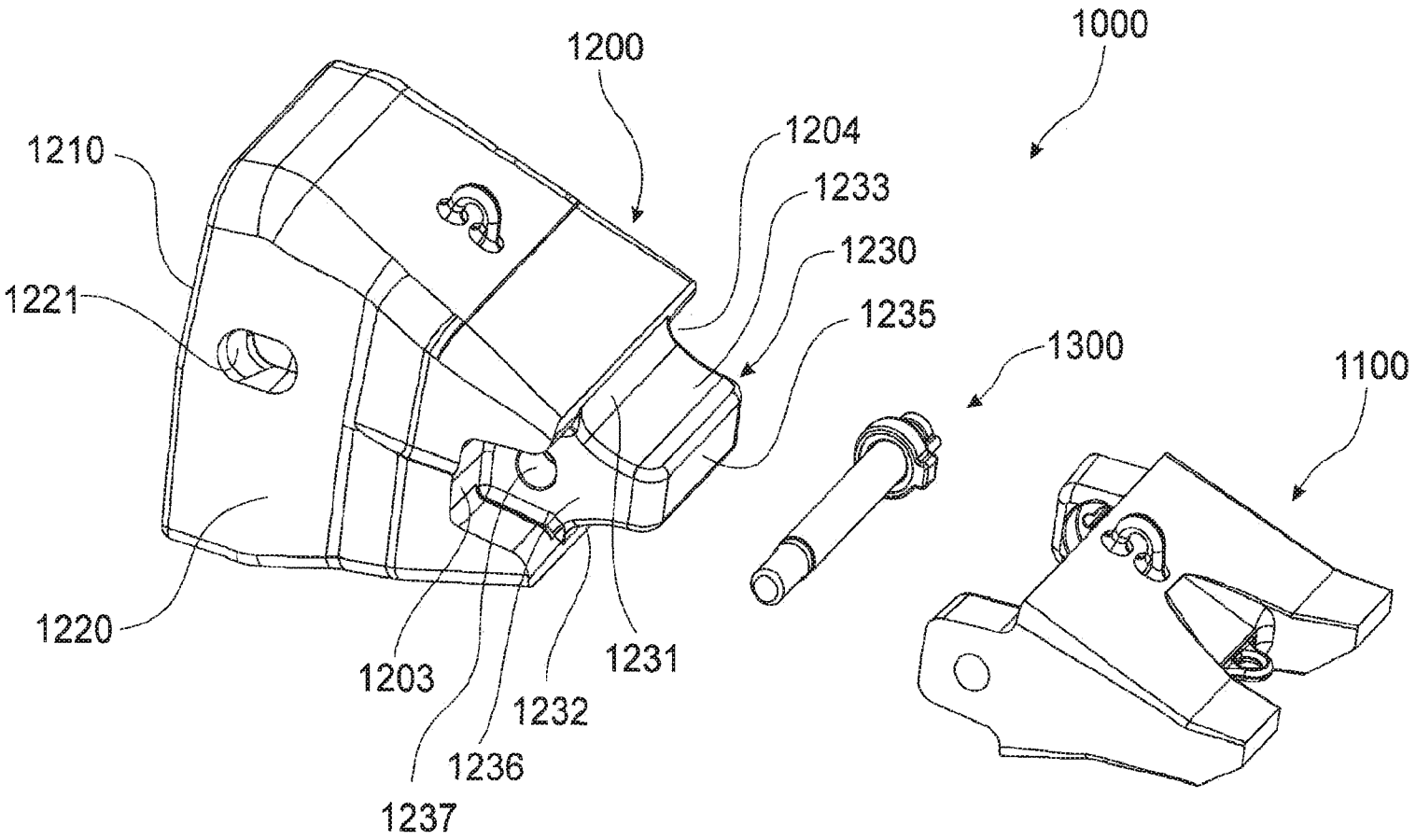
FIG. 1B shows an exploded perspective view of the excavator wear assembly shown in FIG. 1A.

FIG. 1A shows a perspective view of an excavator wear assembly 1000 according to an embodiment of the invention. FIG. 1B shows an exploded perspective view of the excavator wear assembly 1000. Excavator wear assembly 1000 comprises a wear member in the form of a tooth 1100 mountable on an adaptor 1200 and a lock assembly 1300 adapted to releasably secure tooth 1100 on adaptor 1200 as will be discussed in greater detail below.

Adaptor 1200 is suitably configured for mounting on a digging edge of an excavator by way of an adaptor socket 1210. Adaptor socket 1210 is formed in a shape complimentary with a nose of an excavator digging edge (not shown).

Adaptor 1200 has aligned transverse apertures 1221 each extending through a respective opposed side wall 1220. Aligned transverse apertures 1221 are adapted to receive an adaptor retaining pin (not shown) which extends through aligned transverse apertures 1221 and an adaptor retaining pin passage in the complimentary shaped nose (not shown) to thereby retain the adaptor 1200 on the excavator digging edge.

Additionally, adaptor 1200 has a pair of side wall mounting recesses 1203 and 1204 located in a forward portion of respective opposed side wall 1220.

Adaptor 1200 further includes a spigot portion 1230 extending from a forward portion thereof. Spigot portion 1230 has converging upper and lower rear bearing surfaces 1231, 1232 which terminate at substantially parallel upper and lower forward bearing surfaces 1233, 1234 respectively. A front bearing face 1235 is disposed between upper forward bearing surface 1233 and lower forward bearing surface 1234.

Spigot portion 1230 also has a retaining passage 1237 extending therethrough between opposed side walls 1236 thereof.

Figure 2A:
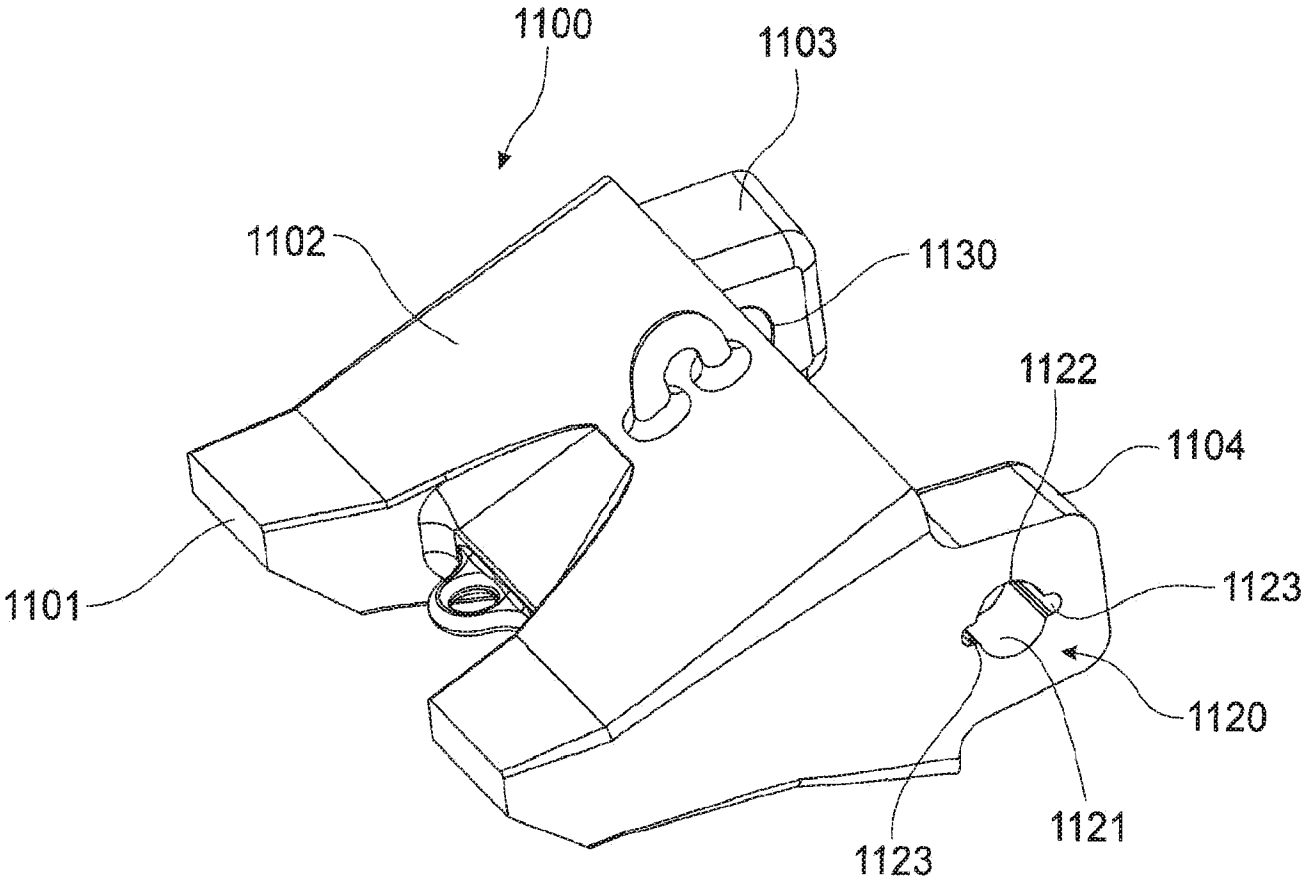
FIG. 2A shows a reverse perspective view of a tooth forming part of the excavator wear assembly shown in FIG. 1A.
Figure 2B:
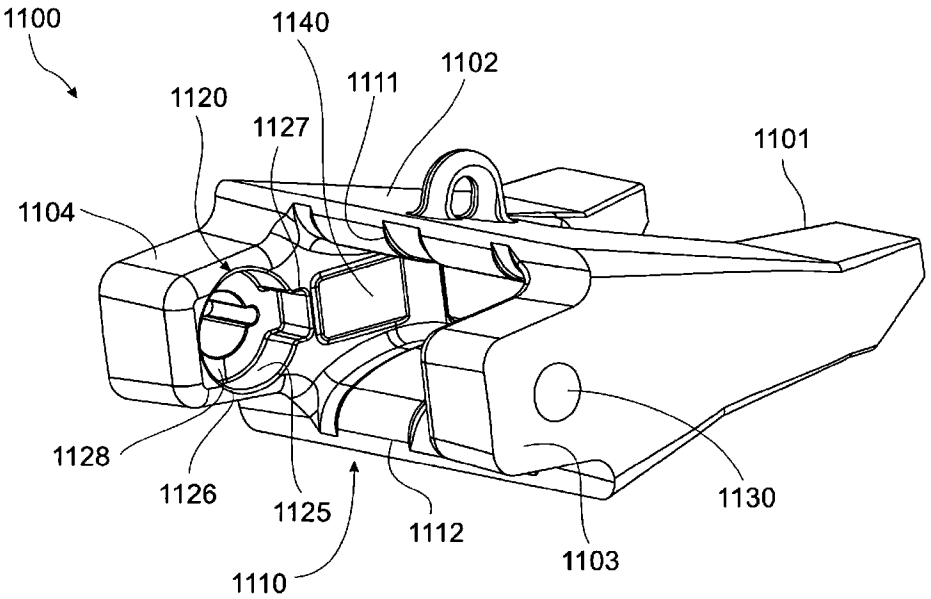
FIG. 2B shows a rear perspective view of the tooth shown in FIG. 2A
Figure 2C:
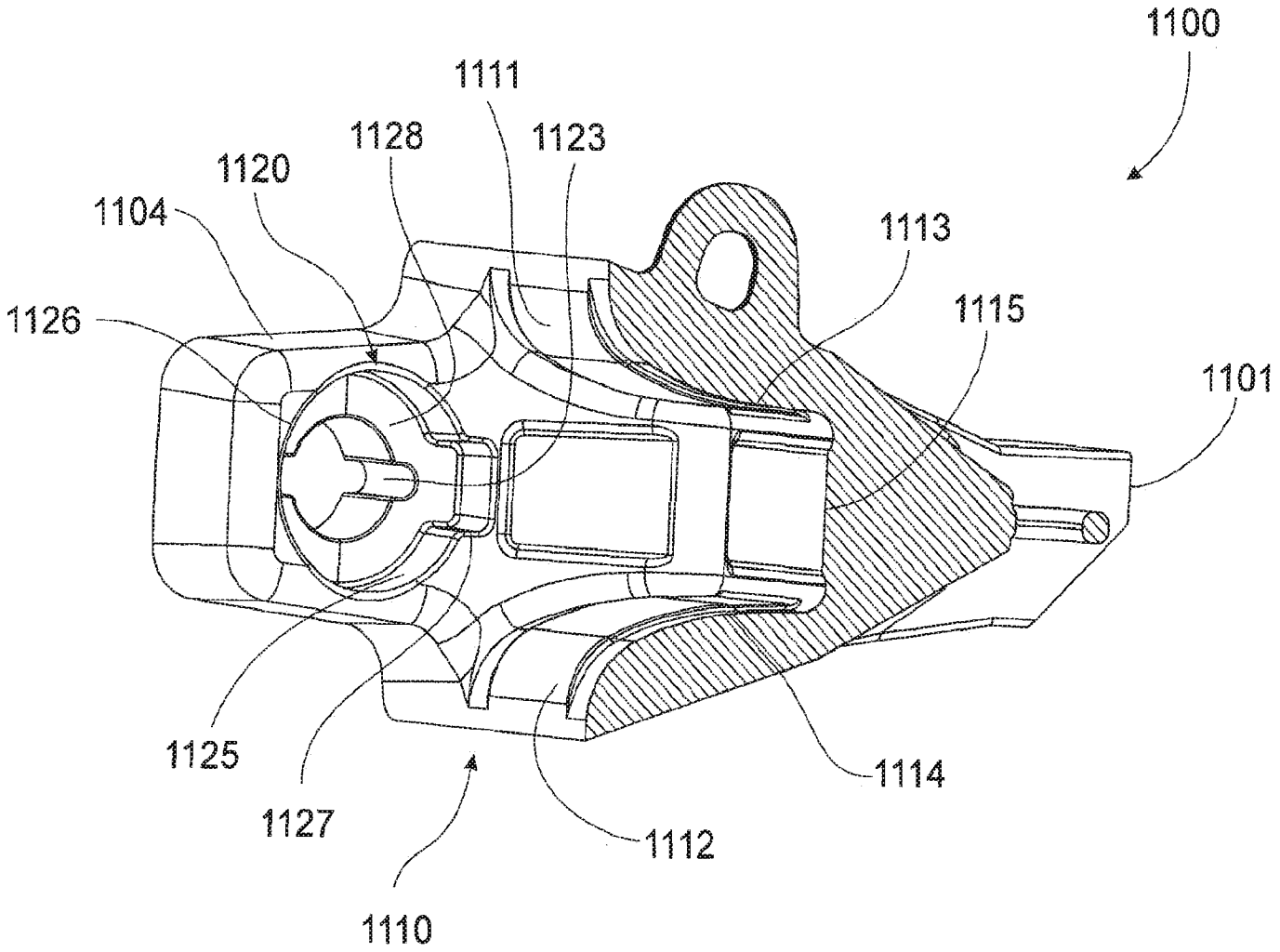
FIG. 2C shows a sectional perspective view of the tooth shown in FIG. 2A.

FIG. 2A shows a reverse perspective view of wear member in the form of tooth 1100. FIG. 2B shows a rear perspective view of the tooth 1100 and FIG. 2C shows a sectional perspective view of the tooth 1100.

Tooth 1100 has a forwardly projecting working end 1101 and a socket cavity 1110 formed from converging upper and lower rear bearing surfaces 1111 and 1112 respectively. Each of upper and lower bearing surfaces 1111 and 1112 terminate at substantially parallel upper and lower forward bearing surfaces 1113 and 1114 respectively. A front bearing face 1115 is disposed between upper forward bearing surface 1113 and lower forward bearing surface 1114.

Bearing surfaces 1111, 1112, 1113, and 1114 and front bearing face 1115 of tooth socket 1110 are configured to be complimentary with bearing surfaces 1231, 1232, 1233 and 1234 and front bearing face 1235 respectively of spigot portion 1230 of adaptor 1200. Socket cavity 1110 is adapted to receive spigot portion 1230 of adaptor 1200.

Tooth 1100 further includes mounting ears 1103 and 1104 extending rearwardly of tooth body 1102 from opposed sides thereof. In use, mounting ears 1103 and 1104 are adapted to be located within mounting recesses 1203 and 1204 respectively of adaptor 1200.

Mounting ear 1104 includes a rib 1140 on an inner face thereof. The rib 1140 is adapted to engage with a respective surface of the spigot portion 1230 of adaptor 1200.

Additionally, a toe aperture 1130 extends through mounting ear 1103 and a locking aperture 1120 extends through opposed mounting ear 1104 as shown. In use, toe aperture 1130 and locking aperture 1120 are adapted to at least partially align with retaining passage 1237 of adaptor 1200.

Toe aperture 1130 is generally circular in cross section and extends through mounting ear 1103 as shown.

Locking aperture 1120 extends through mounting ear 1104 and is formed from a receiving passage 1121 and a retaining recess 1125. Optionally, locking aperture 1120 may extend through any wall of the tooth 1100

Receiving passage 1121 extends inwardly from an outer face of tooth 1100 and terminates at retaining recess 1125 located on an inner face of mounting ear 1104.

Receiving passage 1121 has a generally circular main portion 1122 and a pair of slots 1123 extending outwardly from diametrically opposed sides thereof.

Retaining recess 1125 has a generally circular main portion 1126 and a blind slot 1127 extending outwardly from circular main portion 1126. Circular main portion 1126 of retaining recess 1125 is concentric with circular main portion 1122 of receiving passage 1121 with circular main portion 1126 having a relatively larger diameter thereby forming a locking face 1128 at an inner end of retaining recess 1125.

Similarly, blind slot 1127 generally corresponds with one of slots 1123 of receiving passage 1123 with blind slot 1127 having a relatively larger cross sectional area than each of slots 1123.

Figure 3A:
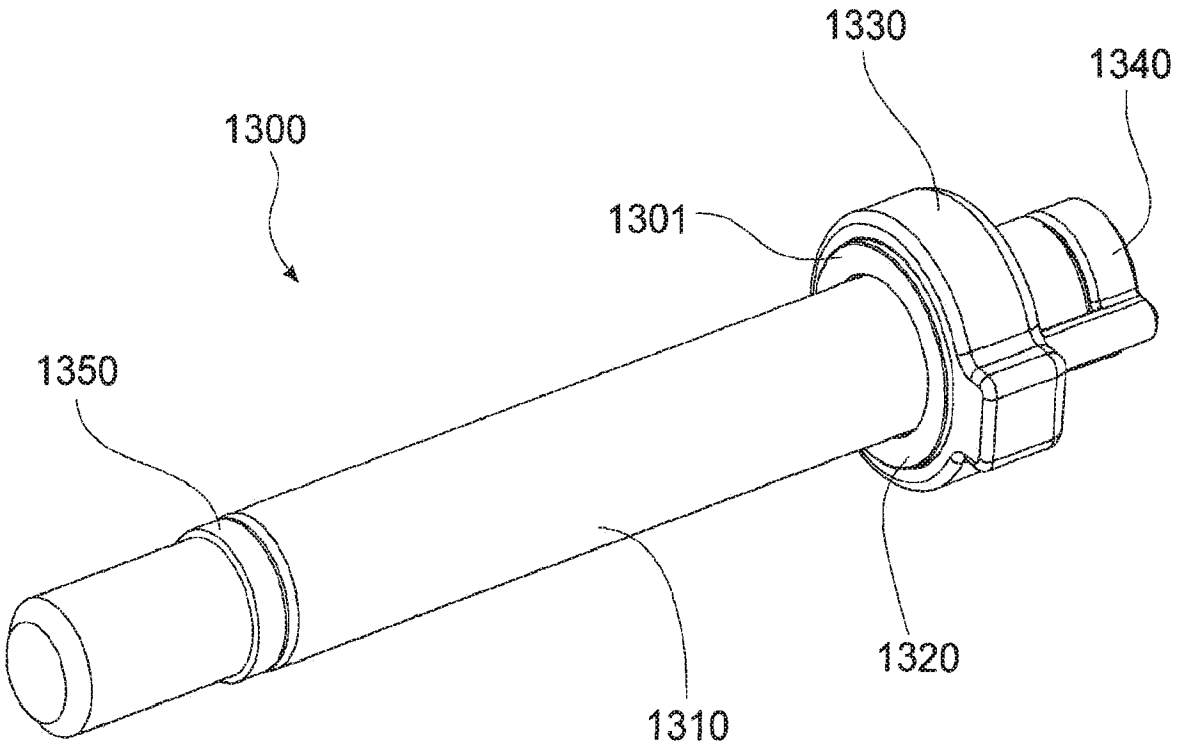
FIG. 3A shows a perspective view of a lock assembly shown in FIG. 1A.
Figure 3B:
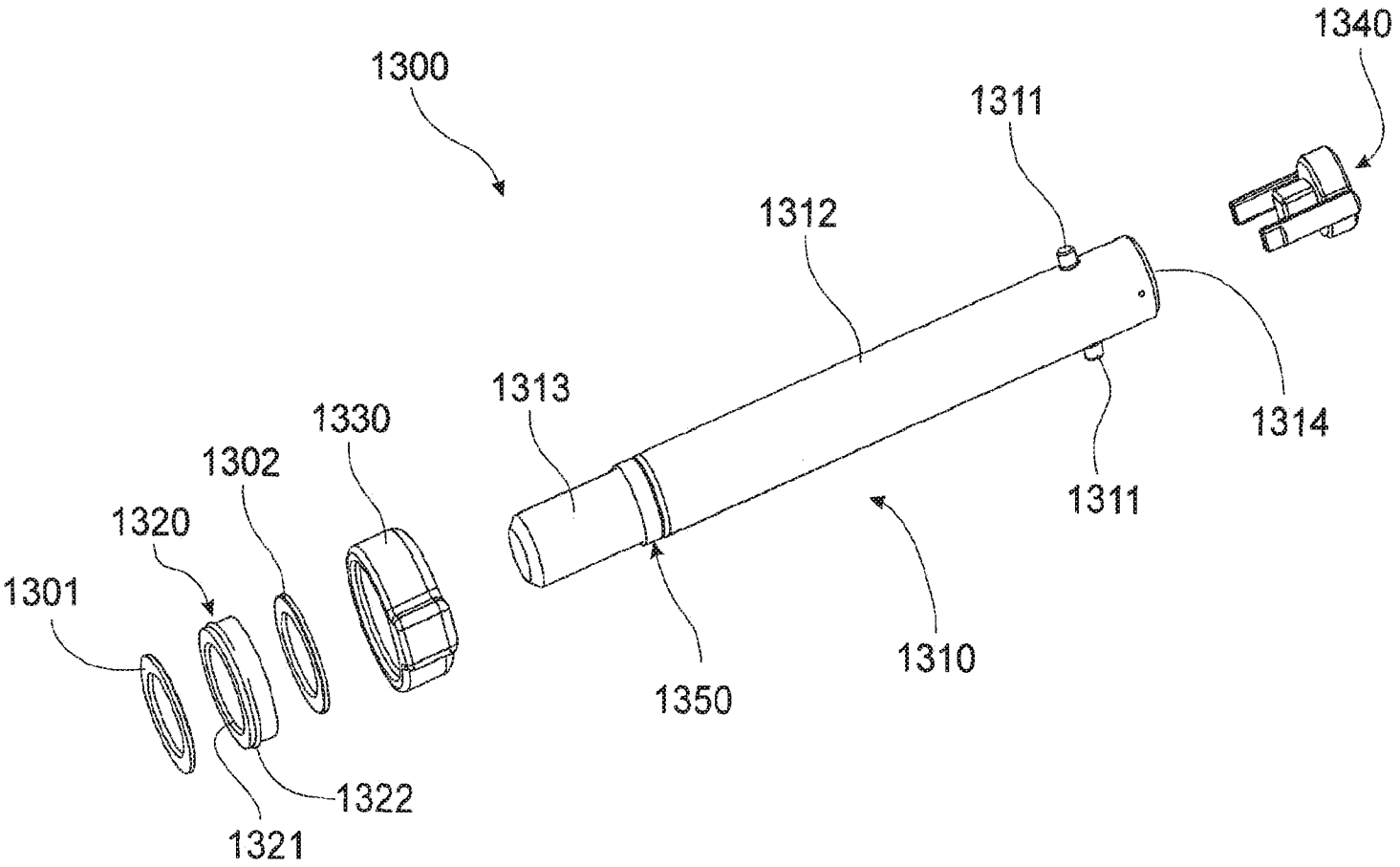
FIG. 3B shows an exploded perspective view of the lock assembly shown in FIG. 3A.

FIG. 3A shows a perspective view of lock assembly 1300 in a locked position and FIG. 3B shows an exploded perspective view of lock assembly 1300.

Lock assembly 1300 comprises a locking pin 1310, a biasing member 1320, a retaining member 1330, a keeper 1340 and a compression washer 1350. Lock assembly further comprises a pair of washers 1301,1302 adapted to locate against opposed faces of biasing member 1320.

Locking pin 1310 has a main portion 1312 and a pair of dowels 1311 extending outwardly from main portion 1312 and an end thereof from diametrically opposed sides thereof.

Dowels 1311 are adapted to be received through respective slots 1123 of receiving passage 1121 as will be discussed in greater detail below.

Locking pin 1310 also has a toe portion 1313 extending from an end of main portion 1312 distal dowels 1311. Locking pin 1310 further comprises a recess 1314 (not shown in FIG. 3A or 3B) located in an end thereof adjacent dowels 1311.

Compression washer 1350 is securely located about toe portion 1313 adjacent main portion 1312.

Toe portion 1313 is adapted to be located in toe aperture 1130 of tooth 1100 as will be discussed in greater detail below.

Biasing member 1320 is generally circular in shape and has an aperture 1321 extending therethrough. Biasing member 1320 is formed from a resiliently deformable plastic or the like and is adapted to be located about main portion 1312 of locking pin 1310. Biasing member 1320 further includes an annular ridge 1322 extending circumferentially about an outer surface thereof.

In use, washers 1301, 1302 adapted to locate against opposed faces of biasing member 1320 such that washer 1302 bears against an inner surface of each dowel 1311 when locking assembly is in the locked position.

Figure 4A:
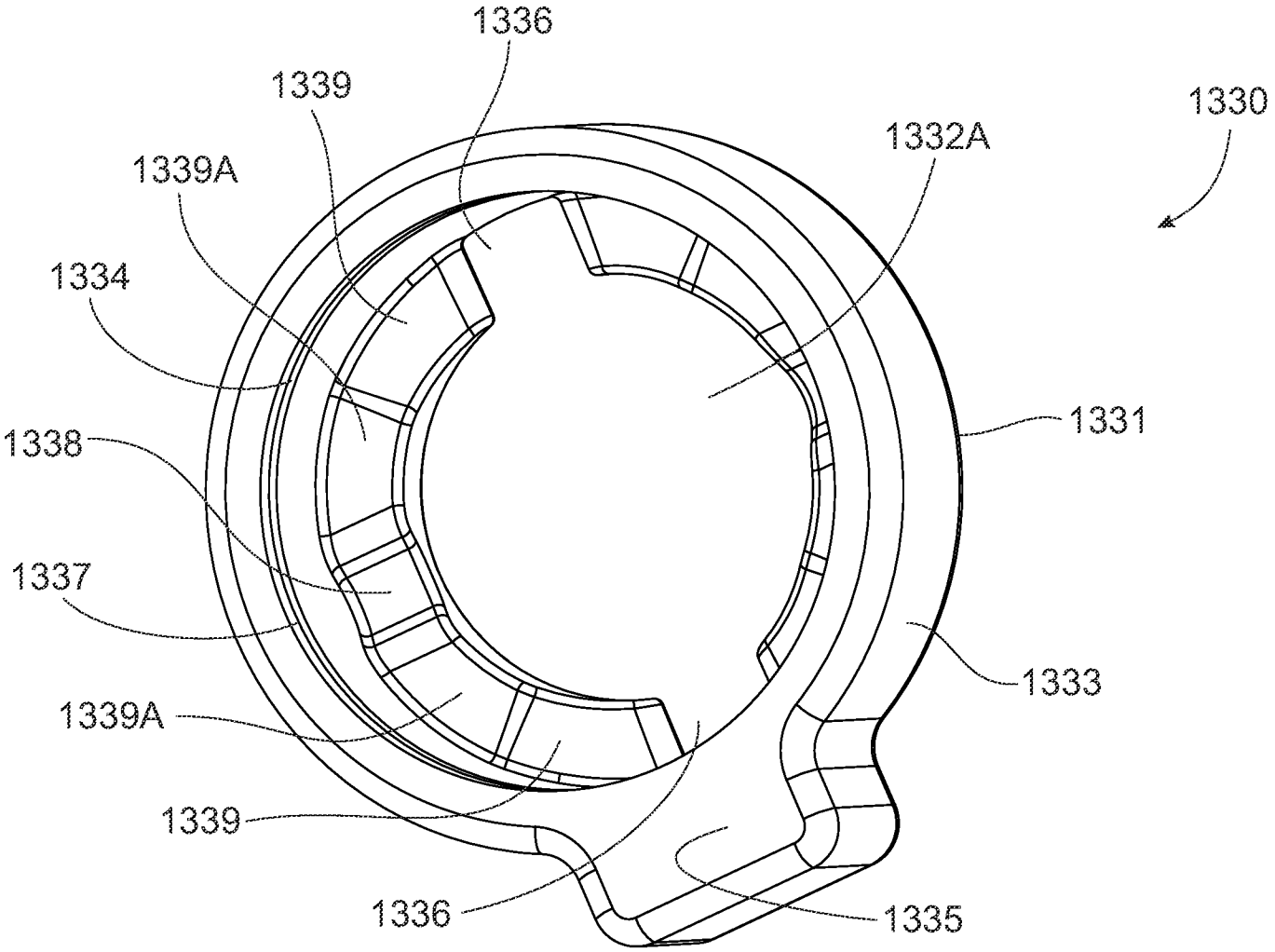
FIG. 4A shows an underside perspective view of a retaining member forming part of the lock assembly shown in FIG. 3A.
Figure 4B:
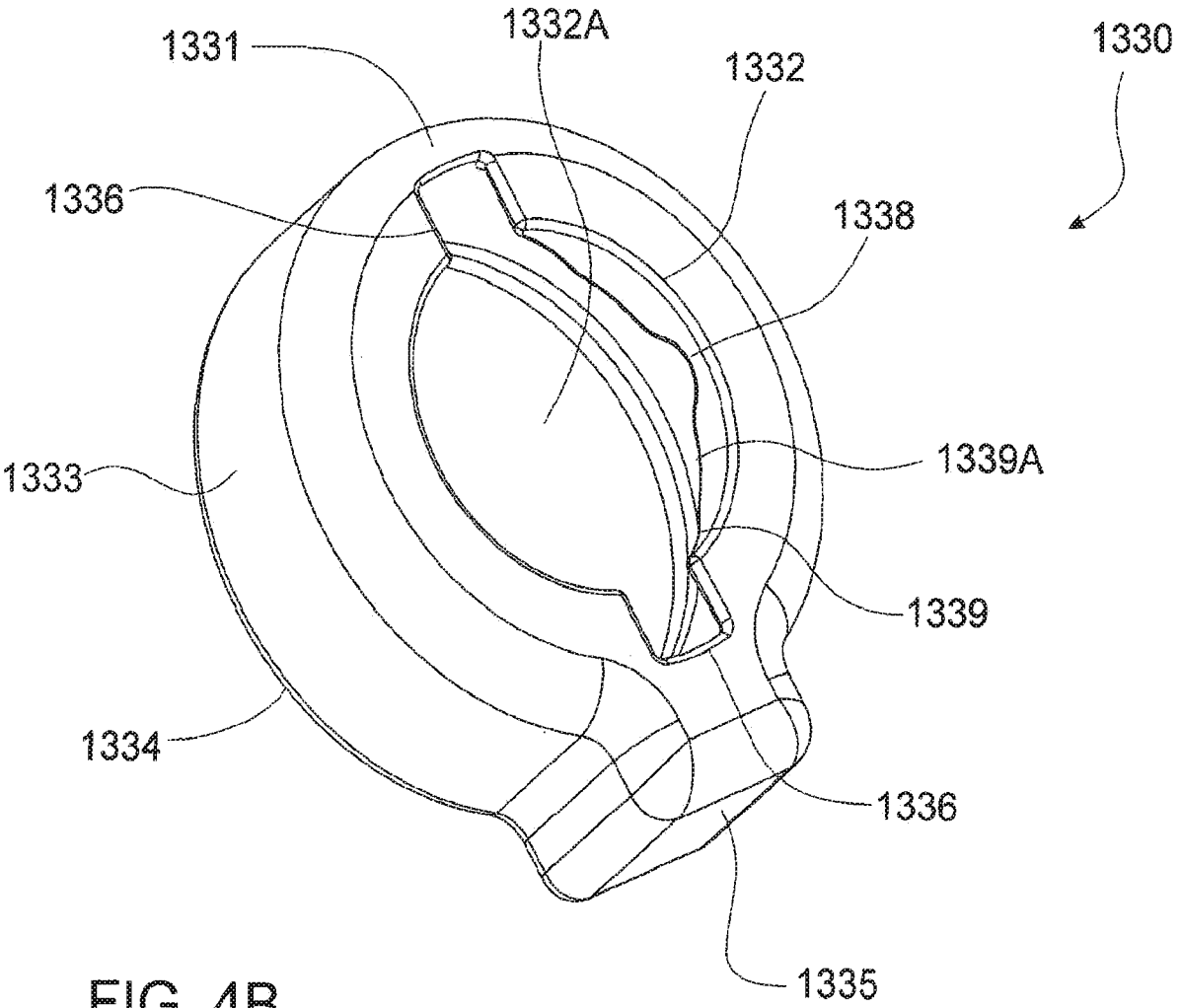
FIG. 4B shows a topside perspective view of the retaining member shown in FIG. 4A.

FIG. 4A shows an underside perspective view of retaining member 1330 and FIG. 4B shows a topside perspective view of retaining member 1330.

Retaining member has a body 1331 formed from a generally planar circular top surface 1332 having an aperture 1332A and an annular wall 1333 extending downwardly from top surface 1332 thereby forming a cavity 1334 adapted to locate biasing member 1320 therein as will be discussed further below. A detent 1335 extends outwardly from body 1331 as shown. Body 1331 is adapted to be received in circular main portion 1126 of retaining recess 1125 and detent 1335 is adapted to be received in blind slot 1127 of retaining recess 1125.

Retaining member 1330 further includes an annular valley 1337 extending circumferentially about an inner face of annular wall 1333 as shown.

A pair of slots 1336 are located on top surface 1332 such that slots are 1336 are diametrically opposed about top surface 1332. Slots 1336 are adapted to receive dowels 1311 of locking pin 1310.

A pair of seats 1338 are located on diametrically opposing sides of an underside of top surface 1332 as shown. Each seat 1338 is adapted to locate a dowel 1311 of locking pin 1310 when locking assembly 1300 is in the locked position.

Retaining member 1330 further includes a number of angled guide surfaces 1339 on an underside of top surface 1332 with each angled guide surface 1339 extending from a respective slot 1336 to a land 1339A such that each land 1339A is disposed between a respective angled guide surface 1339 and a seat 1338.

Suitably, each seat 1338 is axially offset from a slot 1336. Preferably, each seat is axially offset by 90 degrees from each slot 1336.

Figure 5:
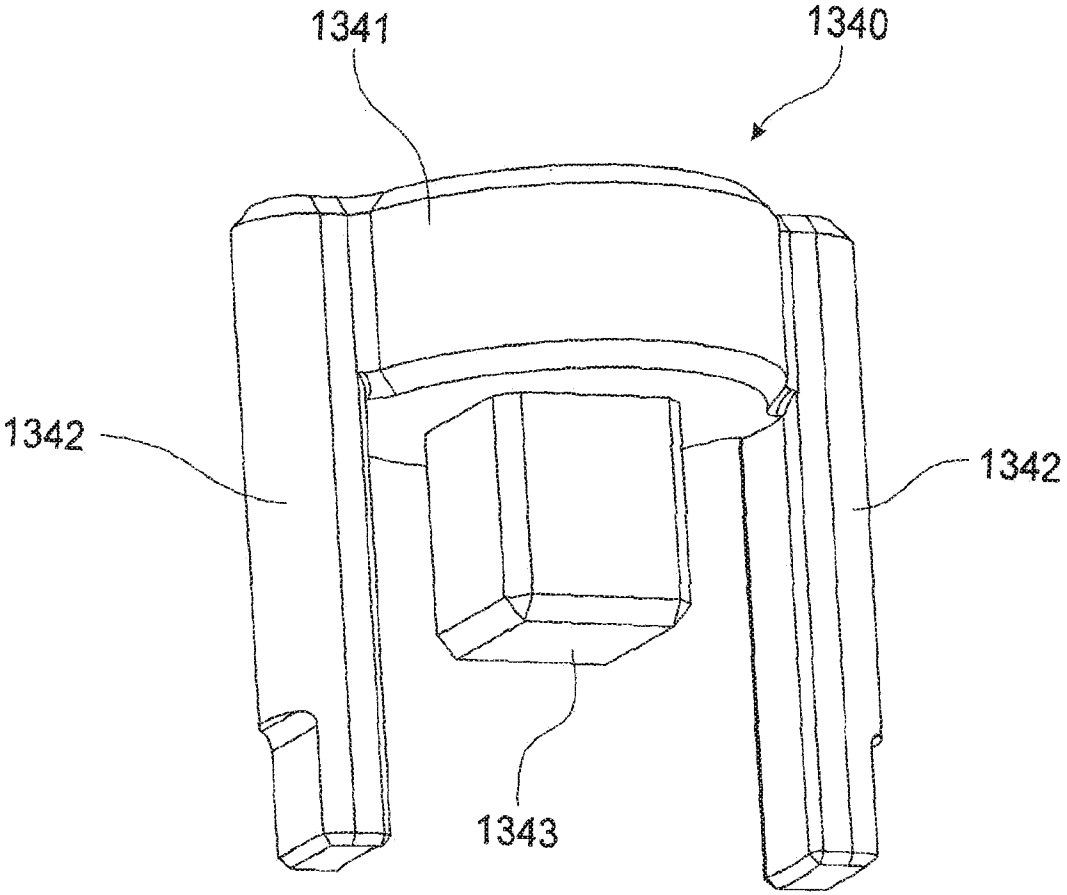
FIG. 5 shows a perspective view of a keeper forming part of the lock assembly shown in FIG. 3A.

FIG. 5 shows a perspective view of keeper 1340 forming part of locking assembly 1300.

Keeper 1340 has a generally circular top portion 1341 and a pair of legs 1342 extending from diametrically opposed sides of top portion 1341. Each leg 1342 is adapted to be received through a slot 1123 of receiving passage 1121 of tooth 1100 and terminate in a respective slot 1335 of retaining member 1330 when lock assembly 1300 is in the locked position.

Keeper 1340 further includes a plug 1343 extending from a central region of an underside of top portion 1341. Plug 1343 is adapted to be securely located within recess 1314 of locking pin 1310.

Lock assembly 1300 is adapted to releasably secure tooth 1100 on adaptor 1200.

Figure 6A:
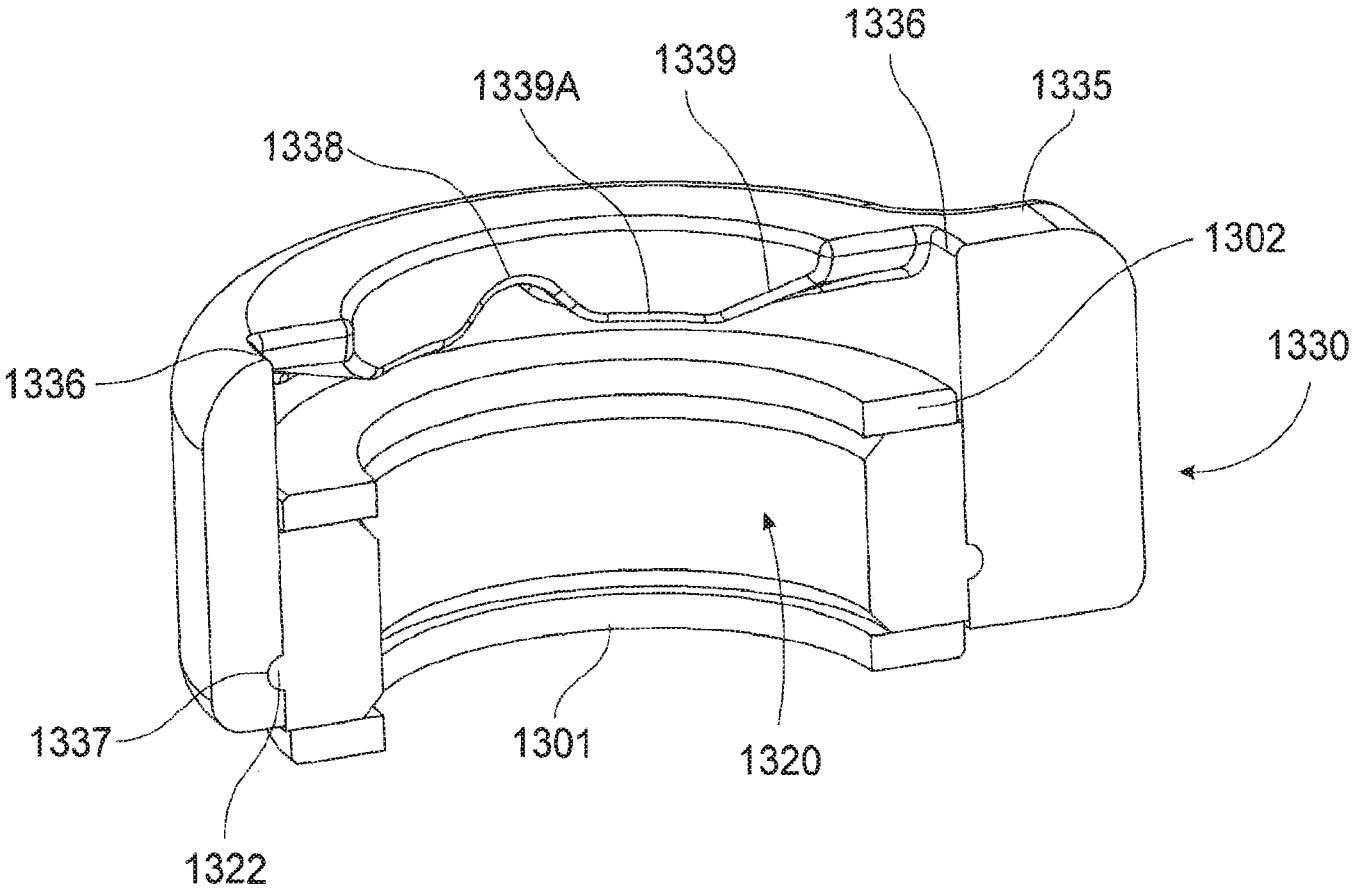
FIG. 6A shows a sectional perspective view of components of the lock assembly shown in FIG. 3A.
Figure 6B:
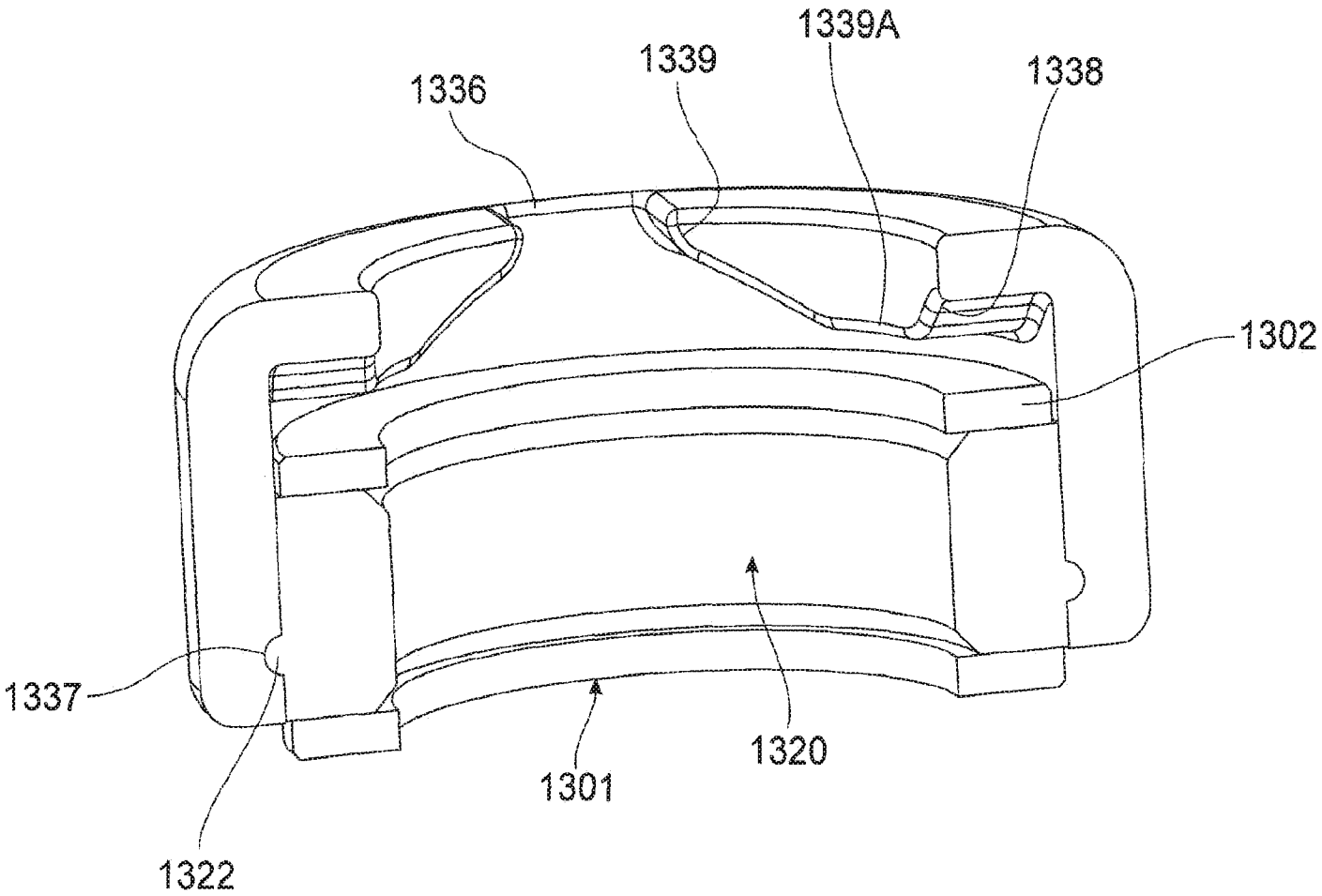
FIG. 6B shows a transverse sectional perspective view of components of the lock assembly shown in FIG. 3A.

FIG. 6A shows a sectional view of washers 1301, 1302 and biasing member 1320 located within cavity 1334 of retaining member 1330 and FIG. 6B shows a transverse sectional view of this arrangement.

As shown, annular ridge 1322 of biasing member 1320 is located within annular valley 1337 of retaining member 1330 such that biasing member 1320 is securely located within cavity 1334.

In a preferred embodiment, washers 1301, 1302 are non-removably secured to opposing faces of biasing member 1320 by means of an adhesive or the like.

In an optional embodiment, the biasing member 1320 may be permanently secured within cavity 1334 of retaining member 1330 by means of a chemical fastener or the like.

Figure 7A:
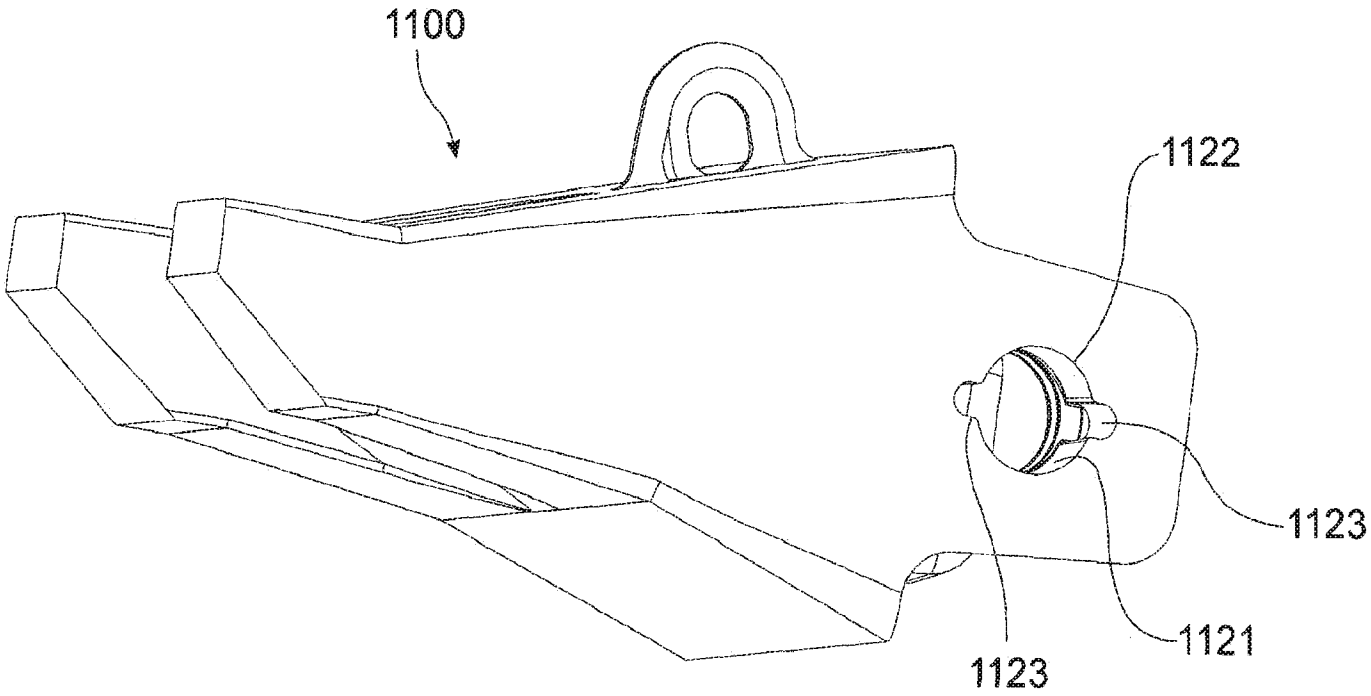
FIG. 7A shows a side perspective view of components of the locking assembly shown in FIG. 3A located within a tooth.
Figure 7B:
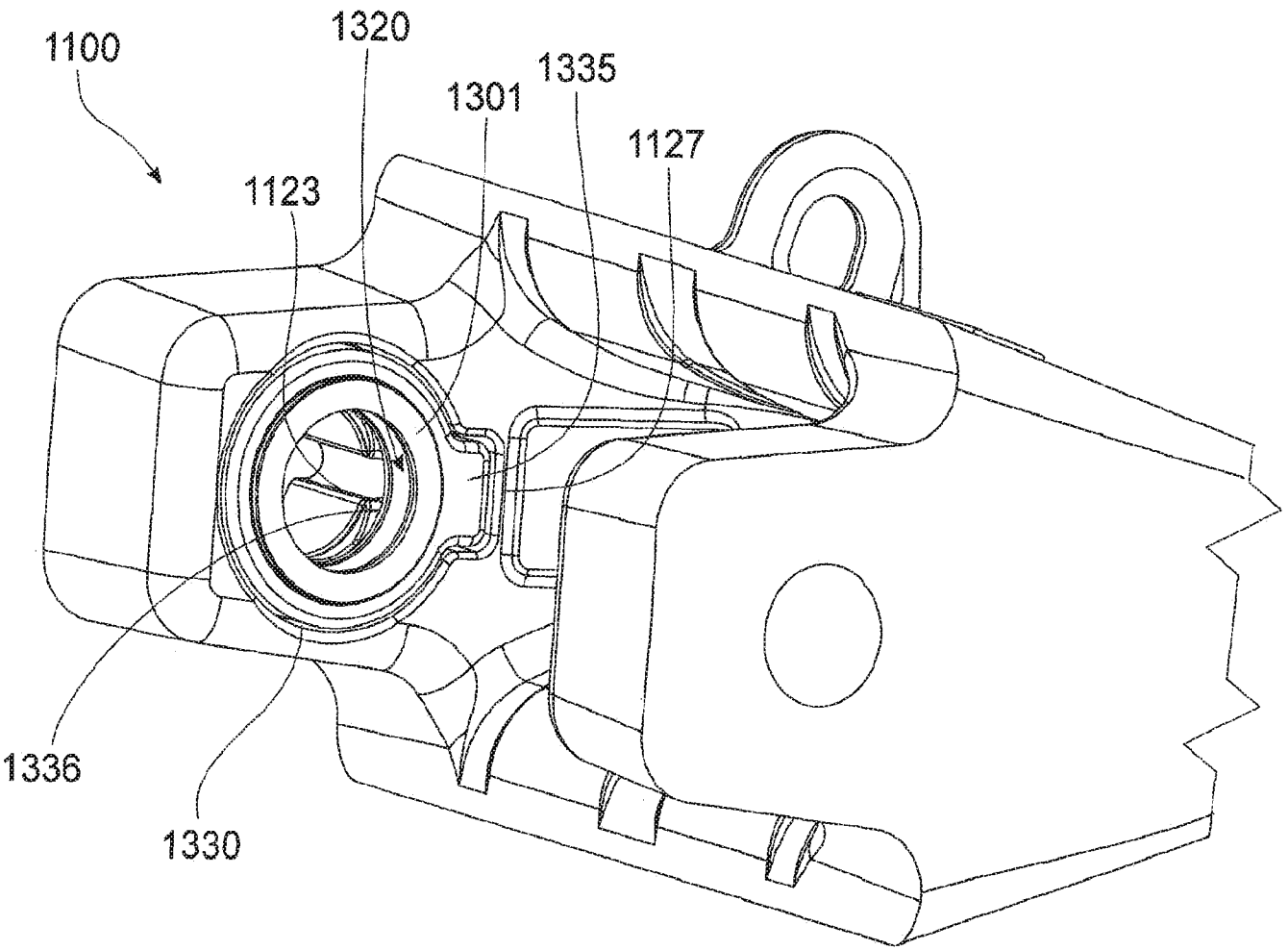
FIG. 7B shows a rear perspective view of the view shown in FIG. 7A.
Figure 7C:
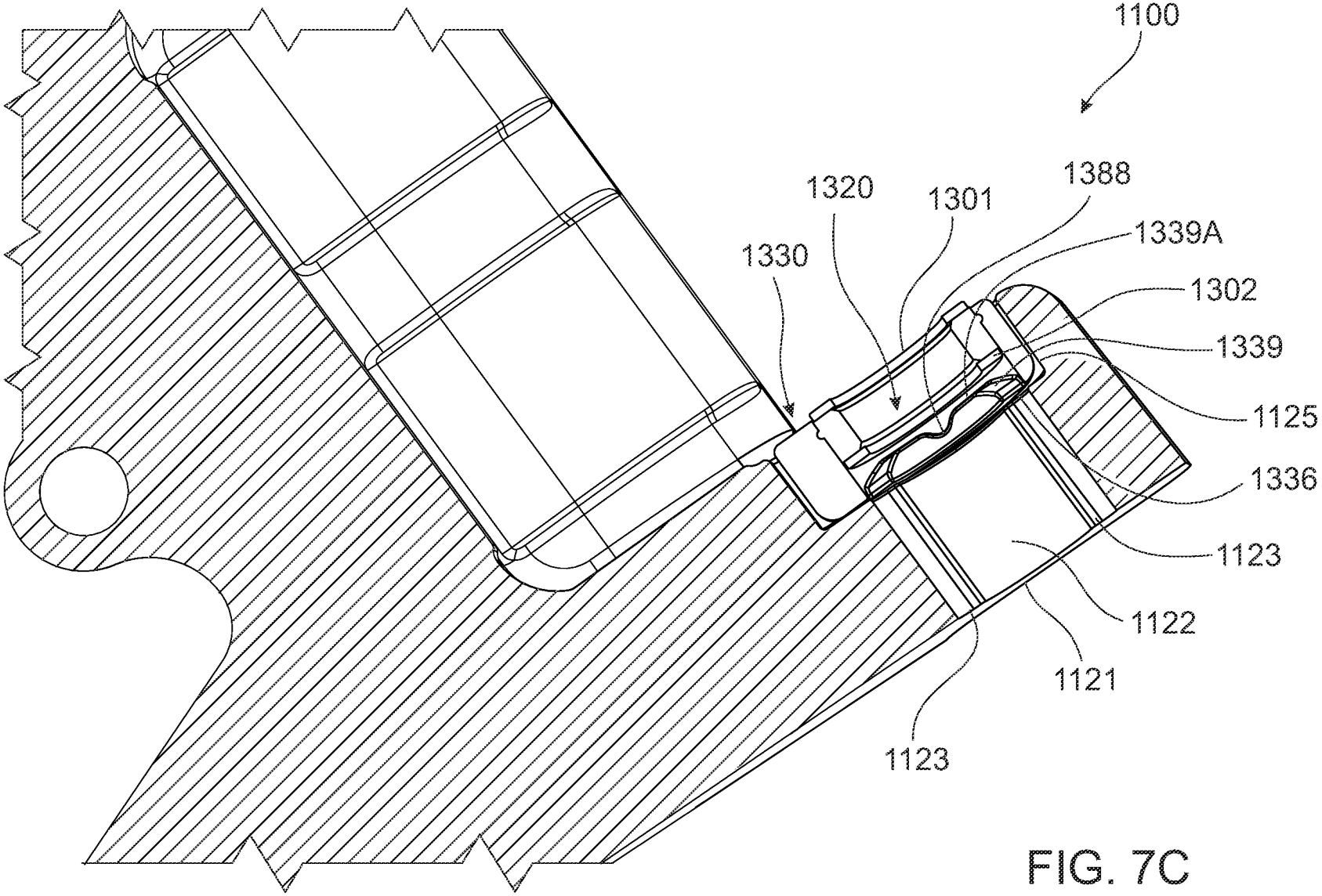
FIG. 7C shows a top sectional view of the view shown in FIG. 7A.

The retaining member 1330 is then located within retaining recess 1125 of locking aperture 1120 of tooth 1100 as shown in FIGS. 7A, 7B and 7C.

In this position, detent 1335 is located within blind slot 1127 thereby non-rotatably locating retaining member 1330 within retaining recess 1125. Furthermore, top surface 1332 of retaining member 1330 abuts locking face 1128 as shown.

Furthermore, slots 1336 of retaining member 1330 align with and correspond to slots 1123 of receiving passage 1121 of tooth 1100 as shown.

In an optional embodiment, retaining member 1330 may be permanently secured within retaining recess of locking aperture 1120 of tooth by means of a chemical fastener or the like such that tooth 1100 is provided in the arrangement as shown in FIGS. 7A-7C. Alternatively, retaining member 1330 may be integrally formed with tooth 1100.

Figure 8A:
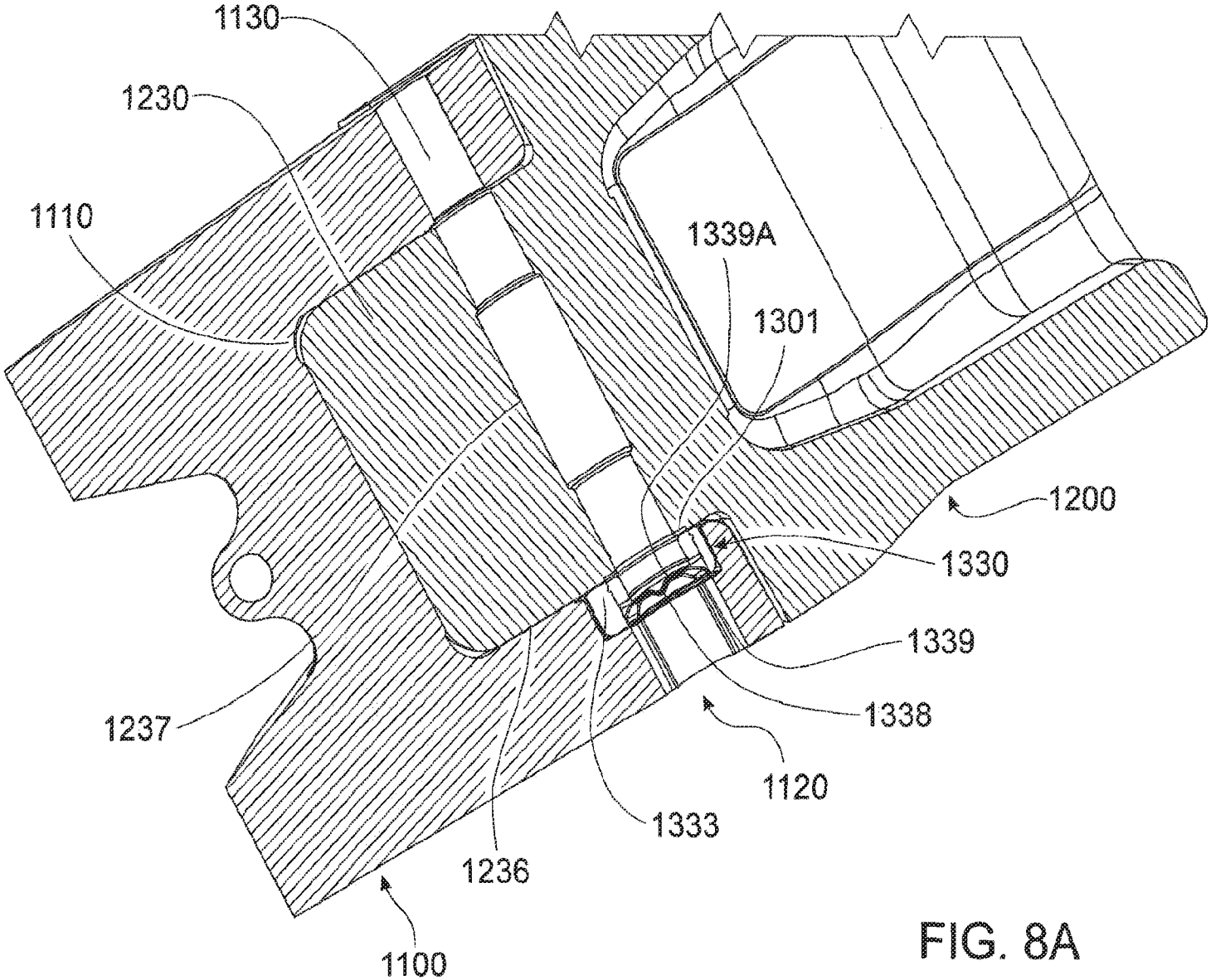
FIG. 8A shows a sectional perspective view of the tooth located on the adaptor.
Figure 8B:
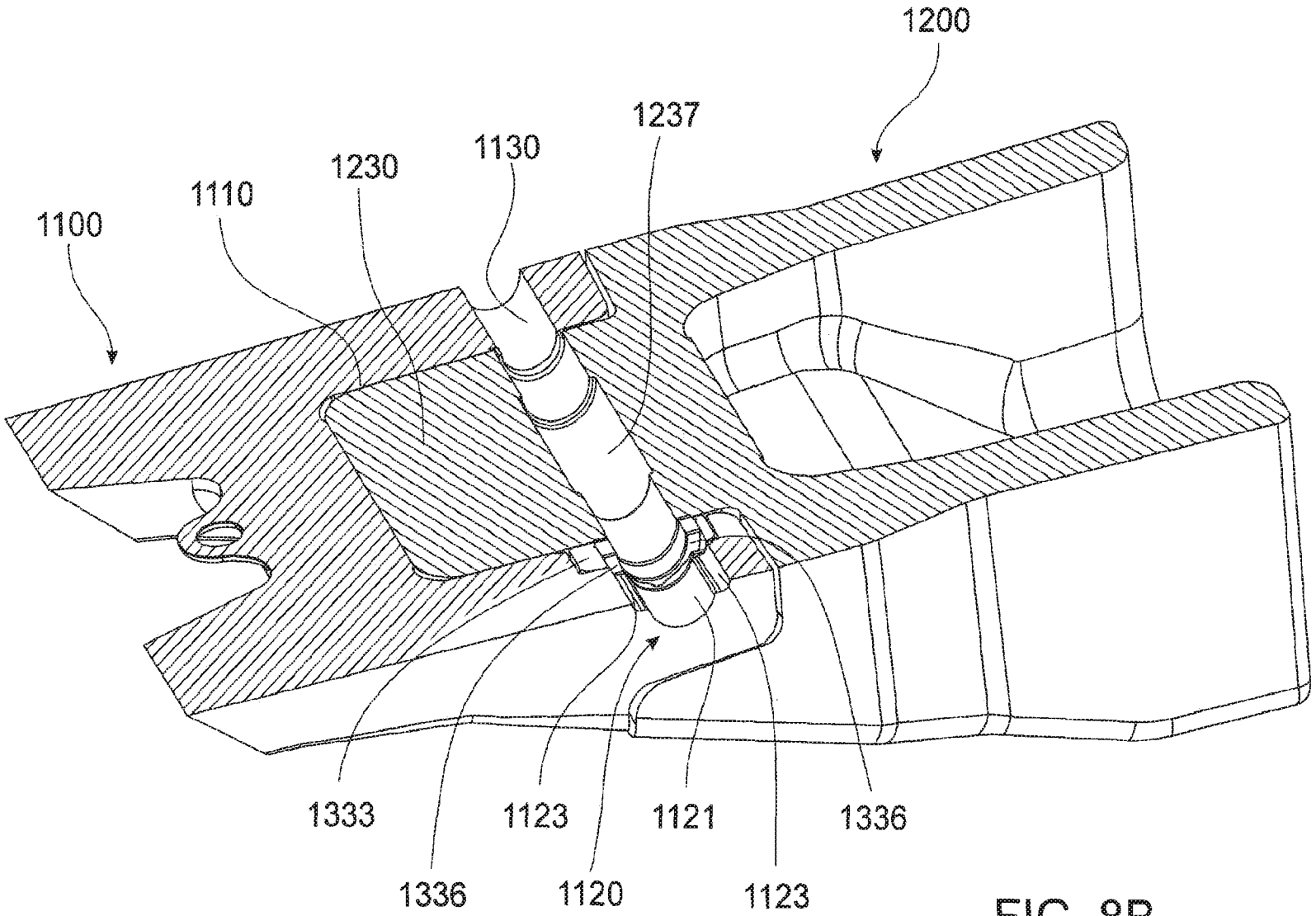
FIG. 8B shows a sectional top view of the tooth located on the adaptor.

The tooth 1100 is then slidably mounted onto adaptor 1200 such that spigot portion 1230 is located within socket cavity 1110 of tooth 1100 as previously discussed and as shown in FIG. 8A and FIG. 8B.

In this position, the retaining member 1330 is captively retained in retaining recess 1124 of tooth 1100 in view of retaining recess 1124 being coaxial with retaining passage 1237 of adaptor 1200. In this way, an outer face of washer 1301 and a lower face of annular wall 1333 of retaining member 1330 both contact an outer face of side wall 1236 of spigot portion 1230 to thereby captively retain retaining member 1330 in retaining recess 1124 a shown.

Figure 9A:
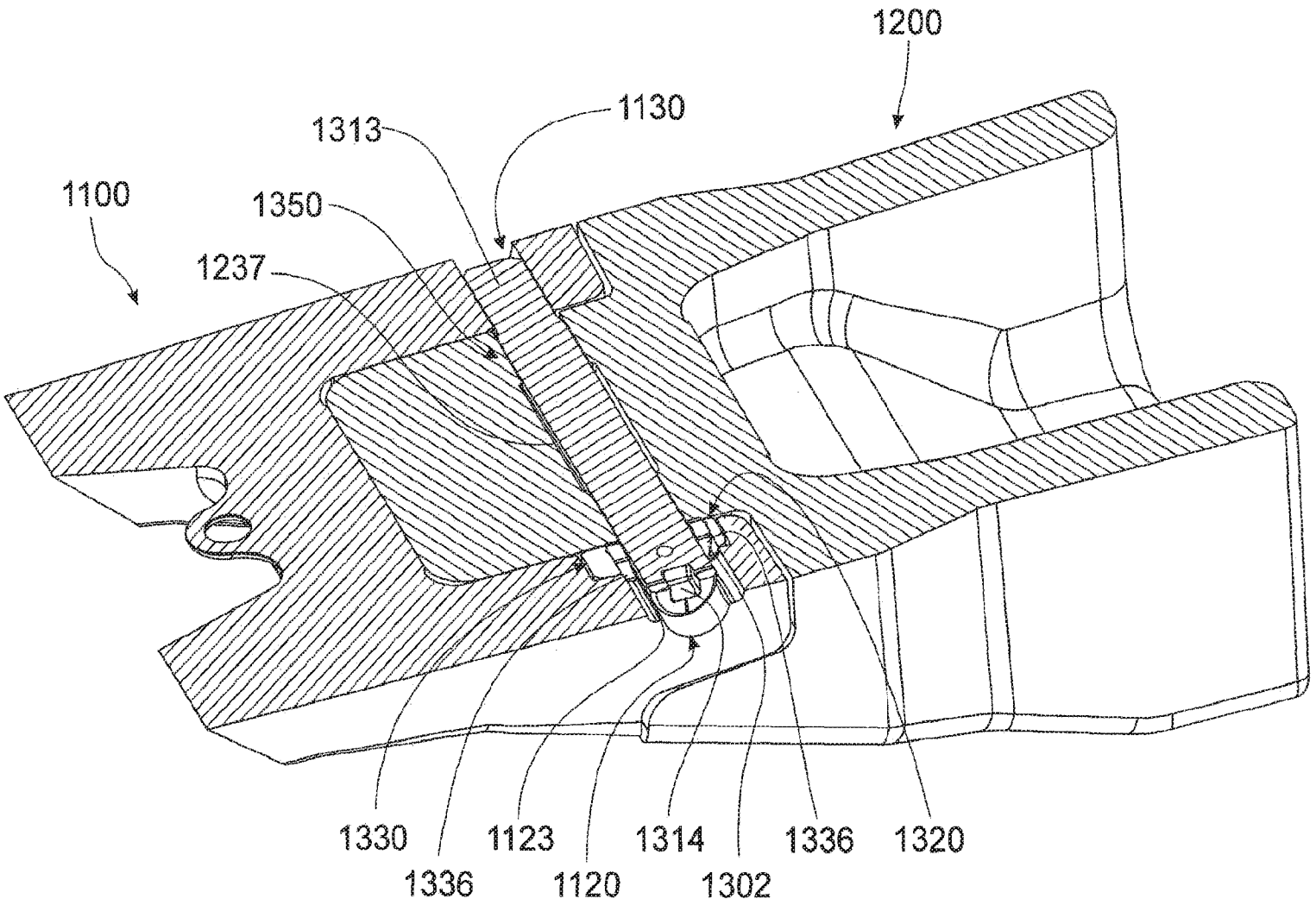
FIG. 9A shows locking pin forming part of the lock assembly located through aligned apertures in the tooth and passage in the adaptor, the locking pin positioned in the locked position.
Figure 9B:
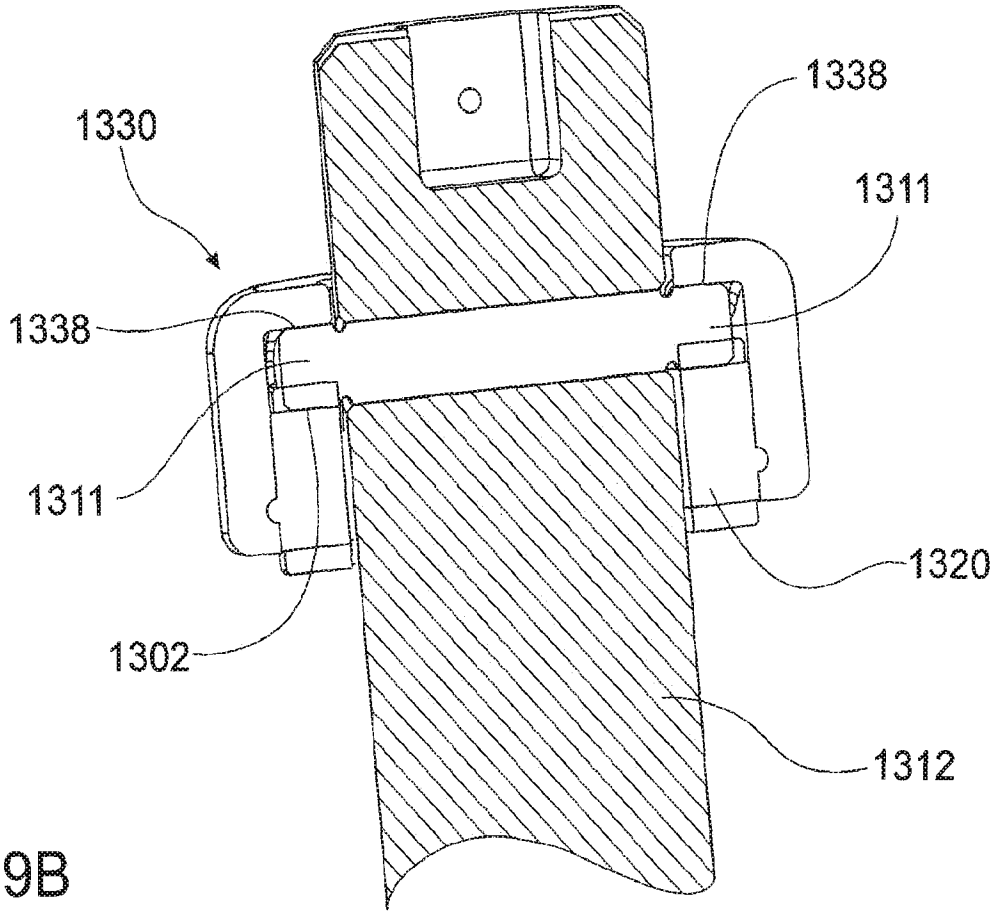
FIG. 9B shows a sectional view of the lock assembly in the locked position.

Retaining pin 1310 of lock assembly 1300 is then located through at least partially aligned locking aperture 1120, retaining passage 1237 and toe aperture 1120 as shown in FIG. 9A in order to place the lock assembly 1300 in the locked position to releasably retain tooth 1100 on adaptor 1200. FIG. 9B shows a section perspective view of locking assembly 1300 in the locked position with the adaptor 1200 and tooth 1100 removed from the view for clarity.

Toe portion 1313 of locking pin 1310 is first located through locking aperture 1120 of tooth 1100. Toe portion 1313 travels through receiving passage 1121 of locking aperture 1120, aligned aperture 1332A of retaining member and 1321 of biasing member 1320 and into retaining passage 1237 of spigot portion 1230 of adaptor 1200.

In this position, or prior to insertion, locking pin is rotated axially about a longitudinal axis thereof such that dowels 1311 are generally coplanar with a plane formed by aligned slots 1336 of retaining member 1330 and slots 1123 of receiving passage 1121 of tooth 1100.

In this orientation of locking pin 1310, dowels 1311 are received through respective aligned slots 1336 and 1123 as locking pin 1310 is further translated within retaining passage until a face of each dowel contacts 1311 contacts an outer face of washer 1302. At this stage of insertion, toe portion 1313 is located within toe aperture 1130 of tooth 1100 as shown.

In this position, lock assembly 1300 is in the insertion position. In order to move lock assembly to the locked position as shown in FIGS. 9A and 9B, locking pin 1310 is rotated axially about a longitudinal axis thereof in order to move each dowel 1311 away from a respective slot 1336 into a respective seat 1338 of retaining member 1300.

Each dowel 1311 has a diameter that is greater in length than a length between an outer face of washer 1302 and an inner surface of land 1339A. As such, as locking pin 1310 is axially rotated, a face of each dowel 1311 is urged into abutment with a face of a respective angled guide surface 1339 whilst an opposing face of each dowel 1311 remains in contact with an outer face of washer 1302.

As previously discussed, biasing member 1200 is formed from a resiliently deformable material such that as the locking pin 1310 is axially rotated and each dowel 1311 travels against a respective angled guide surface 1339, biasing member 1320 is thereby compressed.

When a face of each dowel 1311 bears against a face of a respective land 1339A, biasing member is at full compression. As the locking pin 1310 continues to be axially rotated, a face of each dowel 1311 is urged by the compressive force of biasing member 1320 into a respective seat 1338.

In this position, a face of each dowel 1311 is held in firm abutment with a face of seat 1338 by a biasing force supplied by biasing member 1320 in order to captively retain locking pin 1310 within partially aligned locking aperture 1120, retaining passage 1237 and toe aperture 1120 as shown.

Suitably, a power tool is used to axially rotate locking pin 1310 such that a sufficient force is used to overcome the biasing force of biasing member 1320. Furthermore, locking pin may be rotated in either axial direction in order to move lock assembly 1300 into the locked position from the insertion position.

In the locked position, compression washer 1350 extends about toe portion 1313 within retaining passage 1237 or adaptor 1200 adjacent toe aperture 1130 in order to prevent the ingress of fines and the like therein.

Figure 10A:
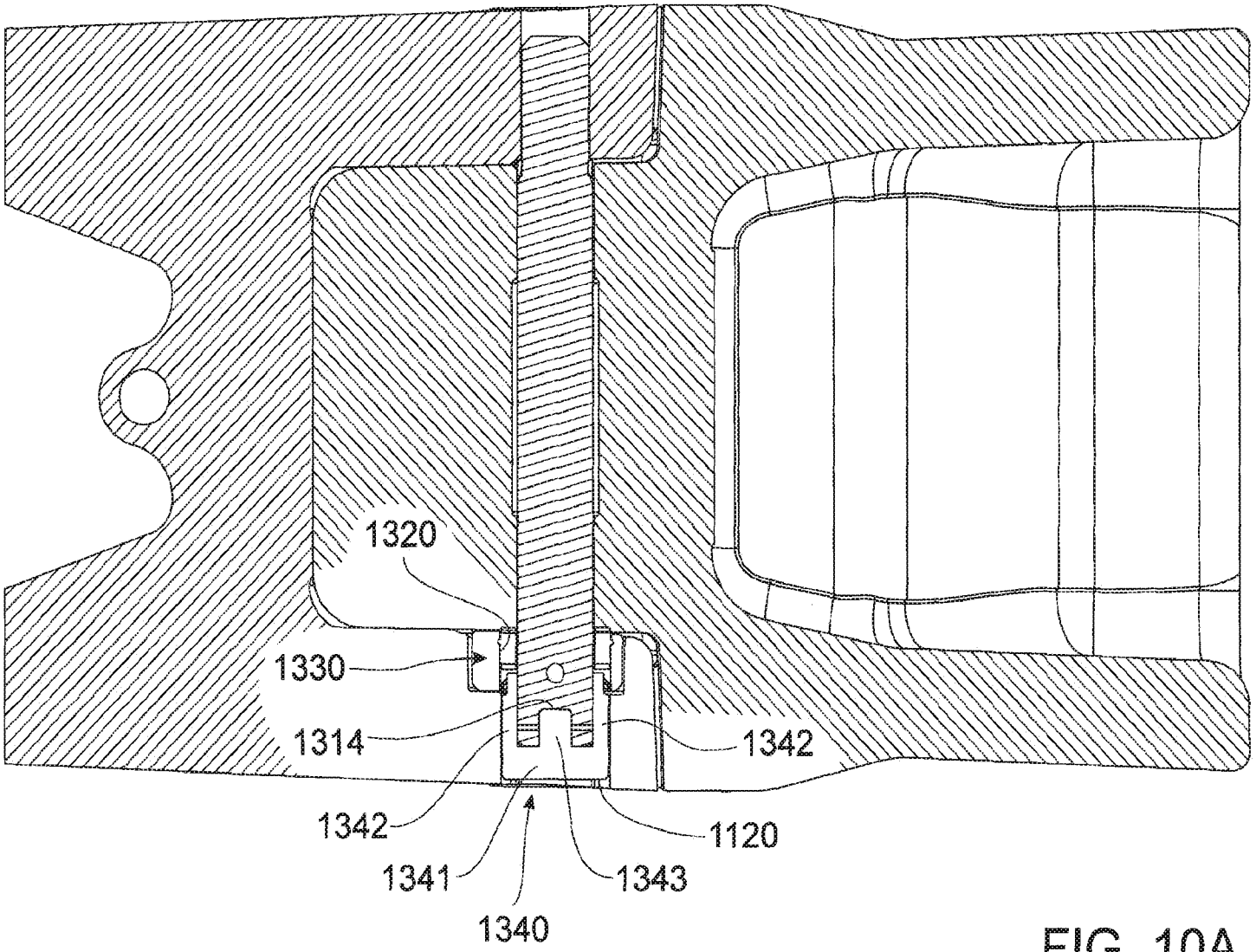
FIG. 10A shows a sectional top view of the lock assembling in the locked position with a keeper associated therewith.
Figure 10B:
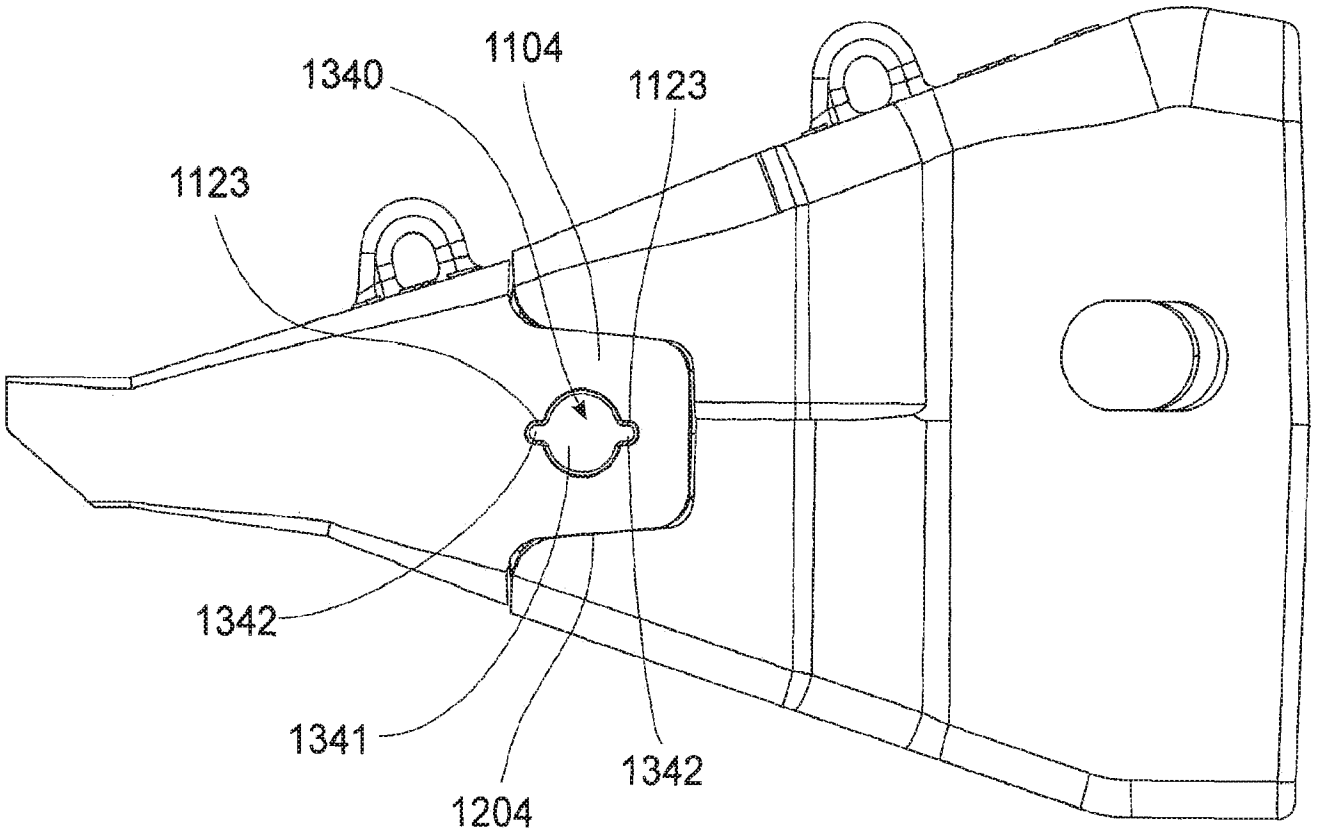
FIG. 10B shows a perspective view of the excavator wear assembly shown in FIG. 1A.

Keeper 1340 is then located within locking aperture 1120 as shown in FIG. 10A and FIG. 10B. Plug 1343 is located within recess 1314 by way of an interference fit in order that keeper 1340 is secured to locking pin 1310. Furthermore, legs 1342 extend through slots 1123 from an outer extent thereof and terminate within cavity 1334 of retaining member 1330.

In this way, the location of legs 1342 ensure that locking pin 1310 cannot rotate to a position such that dowels are in alignment with slots 1336 in the event that the locking pin 1310 is subjected to large rotational loads during use. Keeper 1340 also prevents ingress of fines and the like into locking aperture 1120.

In order to move lock assembly 1300 to the insertion position, the keeper 1340 is removed and the locking pin 1310 is suitably rotated in order that dowels 1311 align with respective aligned slots 1336 and 1123 in order that locking pin 1310 may be withdrawn to remove tooth 1100 from adaptor 1200.

Figure 11A:
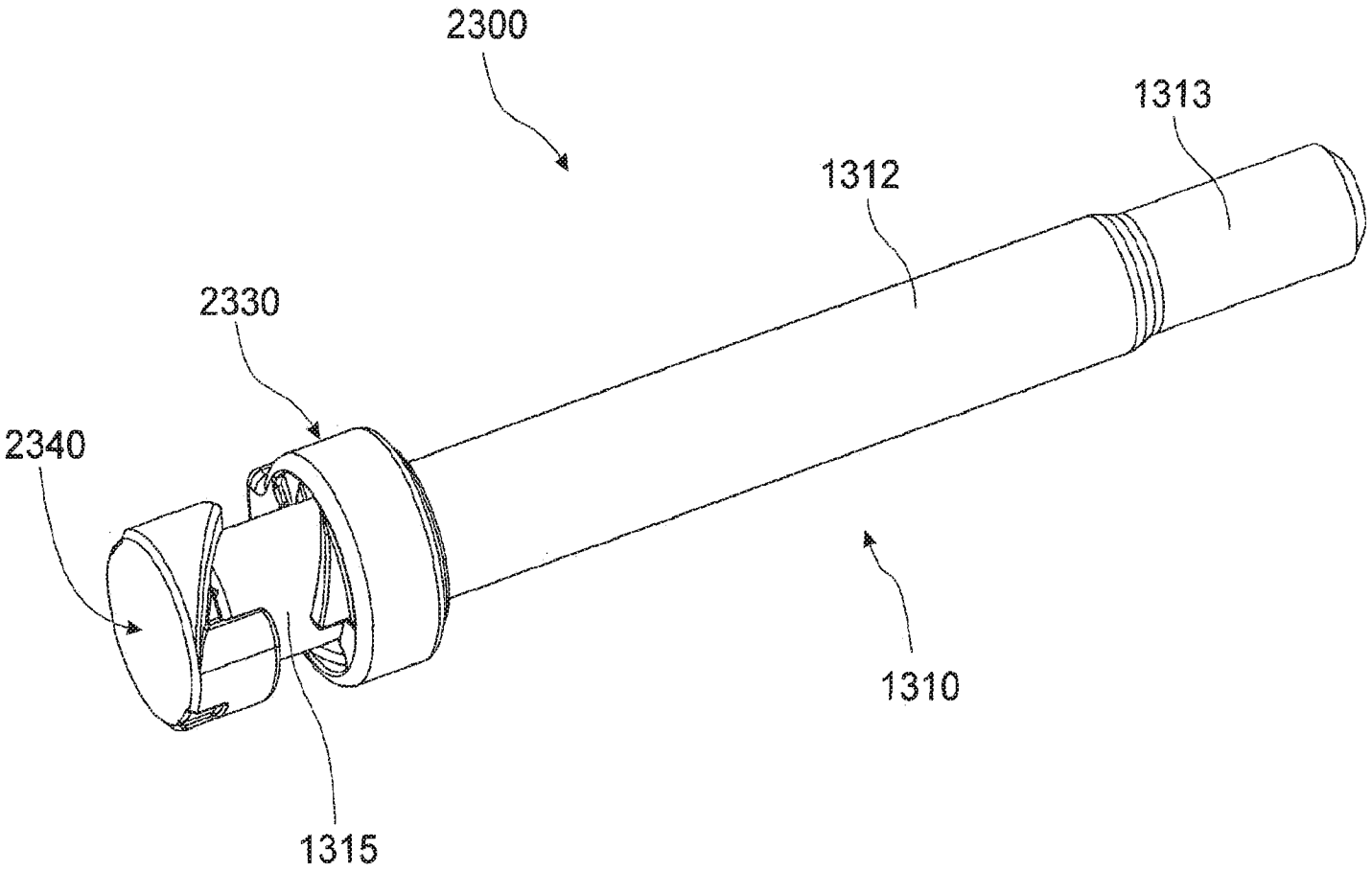
FIG. 11A shows a perspective view of a lock assembly according to a further embodiment of the invention.
Figure 11B:
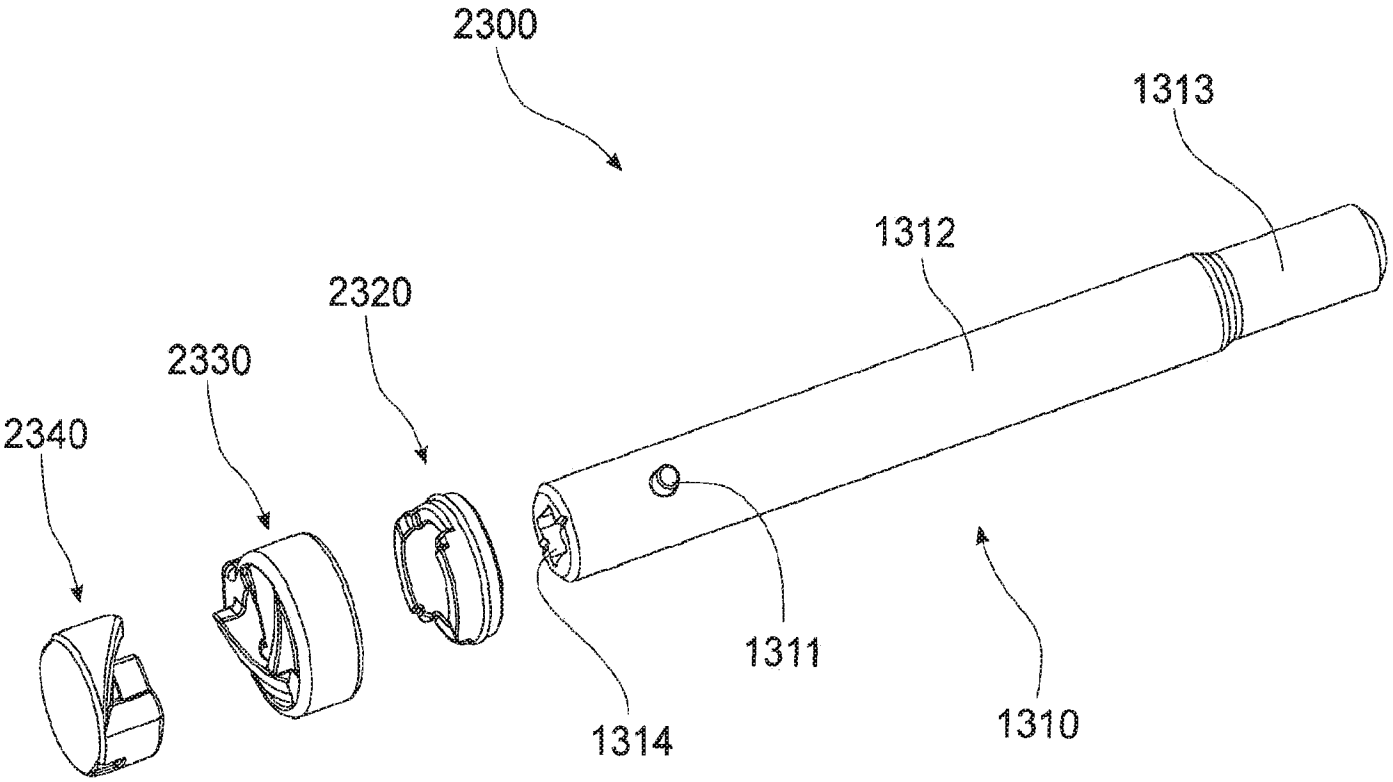
FIG. 11B shows an exploded perspective view of the lock assembly shown in FIG. 11A

FIG. 11A shows a perspective view of a lock assembly 2300 according to a further embodiment of the invention. FIG. 11B shows an exploded perspective view of lock assembly 2300.

Lock assembly 2300 has a locking pin 1310 as previously described. Lock assembly 2300 also comprises a biasing member 2320, a retaining member 2330 and a keeper 2340 as discussed in greater below.

As shown most clearly in FIG. 11A, when biasing member 2320, retaining member 2330 and keeper 2340 are fitted to locking pin 1310, a channel 1315 is formed between keeper 2340 and retaining member 2330.

Figure 12A:
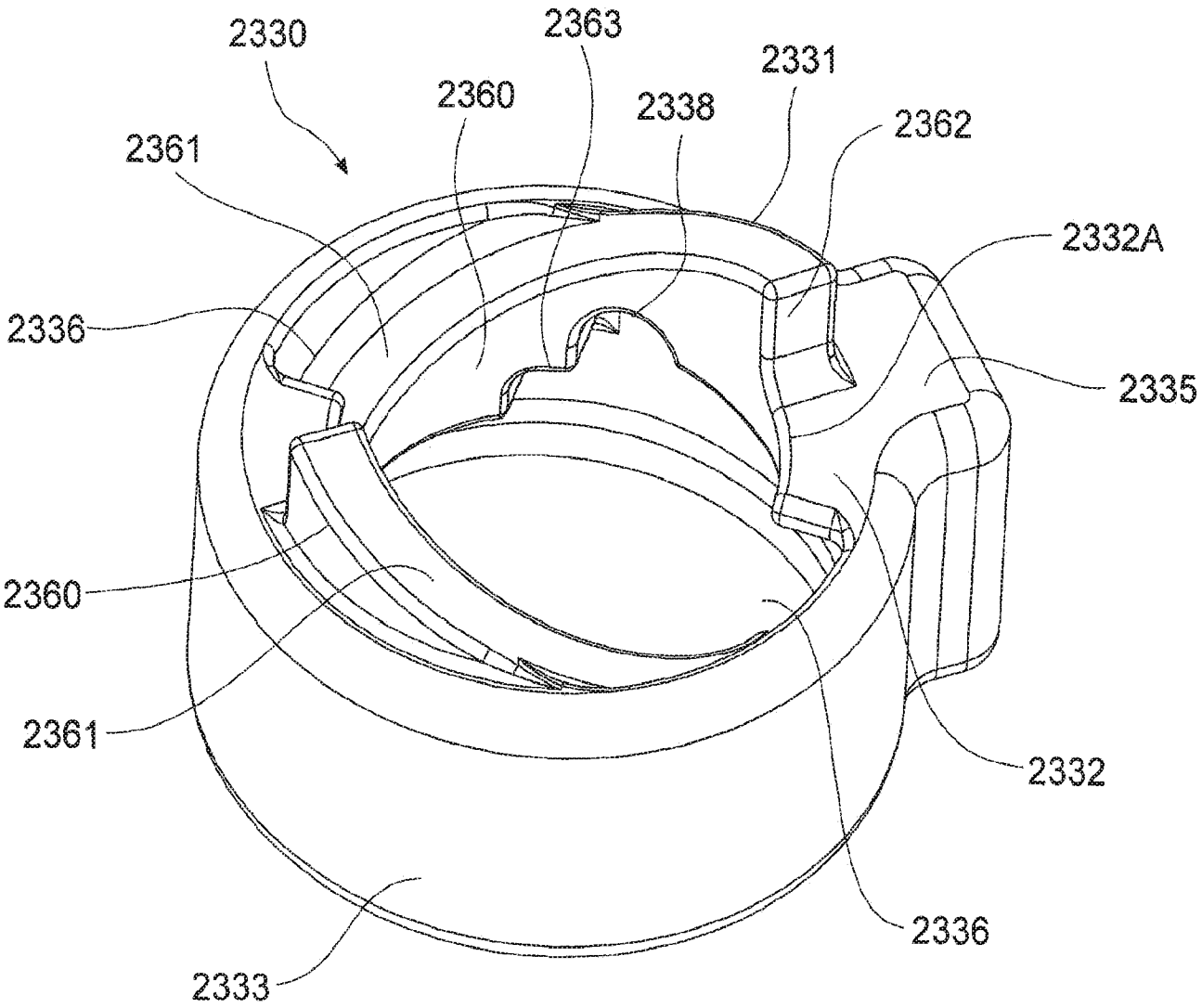
FIG. 12A shows a topside perspective view of a retaining member forming part of the lock assembly shown in FIG. 11A.
Figure 12B:
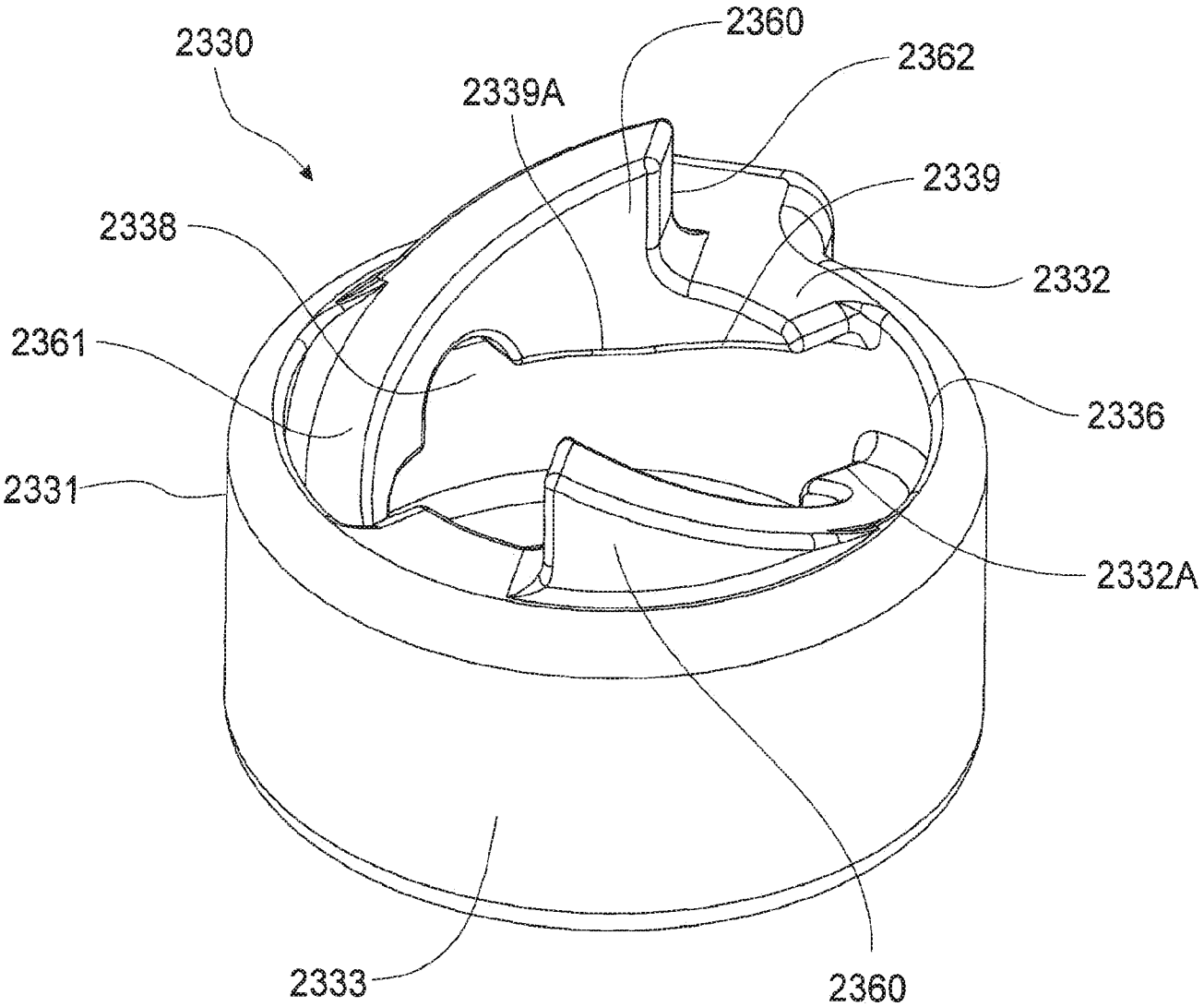
FIG. 12B shows a further topside perspective view of the retaining member shown in FIG. 12A.
Figure 12C:
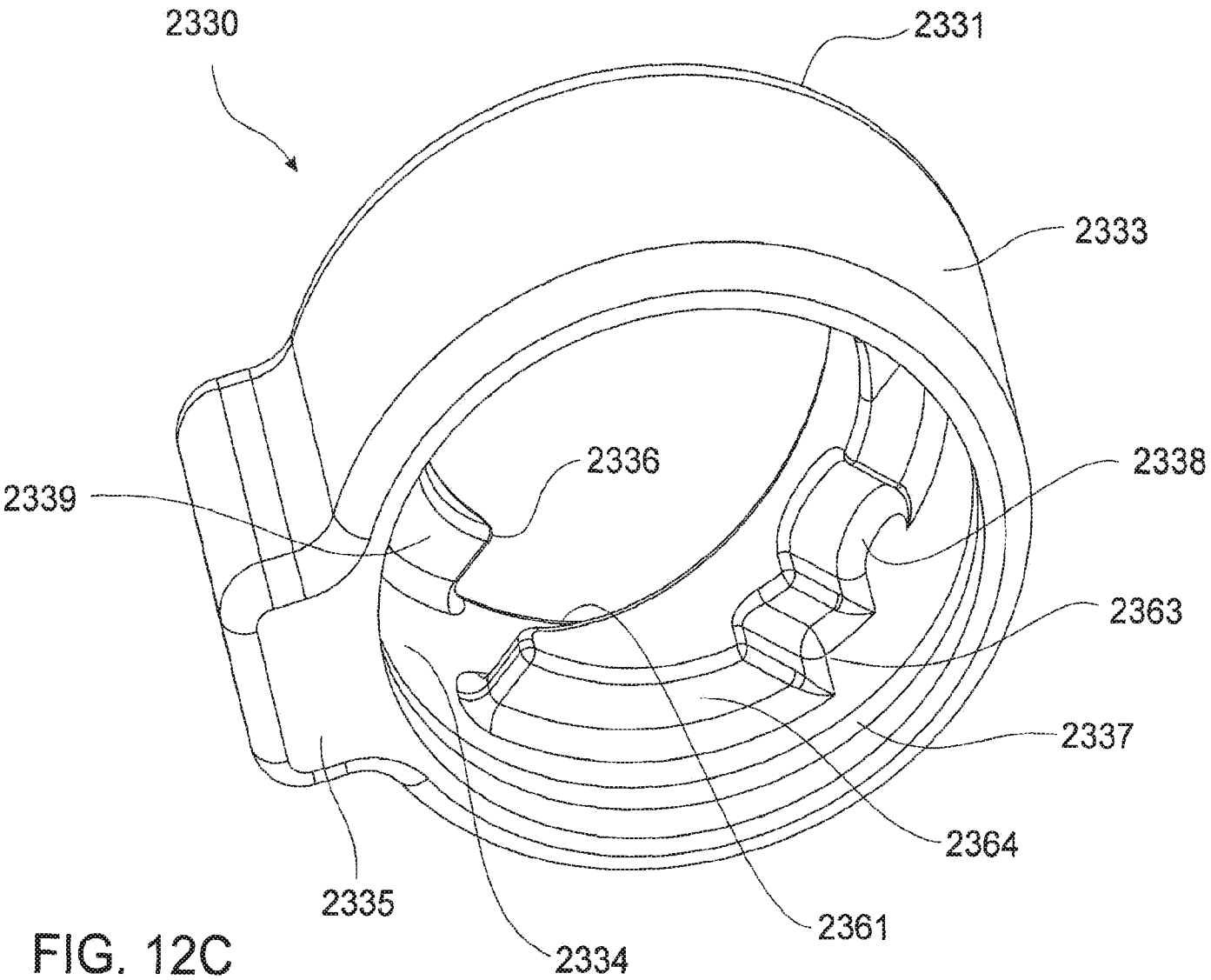
FIG. 12C shows an underside perspective view of the retaining member shown in FIG. 12A.
Figure 12D:
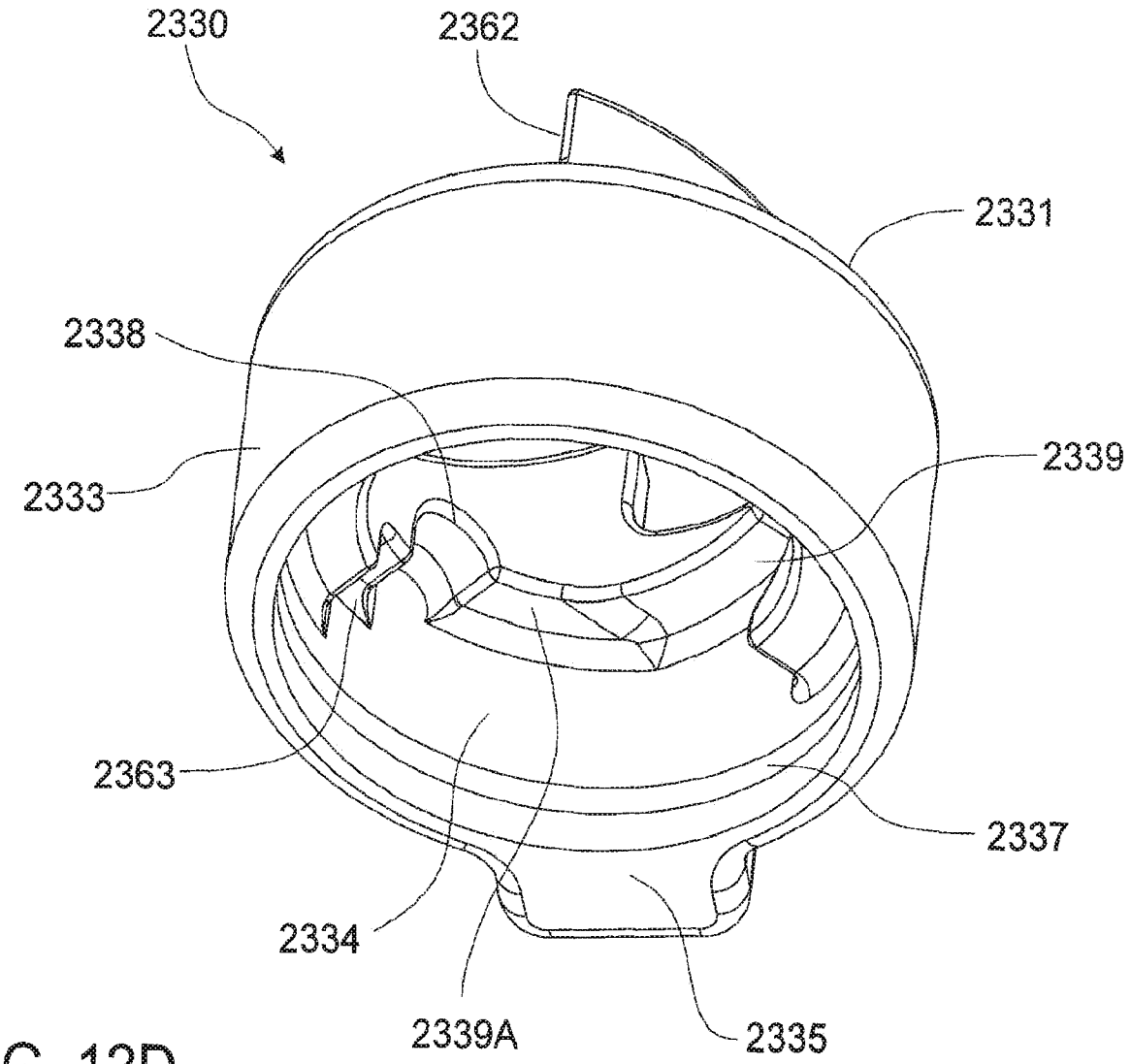
FIG. 12D shows a further underside perspective view of the retaining member shown in FIG. 12A.

FIG. 12A and FIG. 12B show top side perspective views of retaining member 2330 forming part of the lock assembly 2300. FIG. 12C and FIG. 12D show underside perspective views of retaining member 2330.

Retaining member 2330 has a body 2331 having an aperture 2332A extending through a top surface 2332 thereof. An annular wall 2333 extends downwardly from top surface 2332 thereby forming a cavity 2334 adapted to locate biasing member 2320 therein as will be discussed in further detail below. A detent extends 2335 extends outwardly from body 2331 as shown.

Retaining member 2330 further includes an annular valley 2337 extending circumferentially about an inner face of annular wall 2333 as shown.

A pair of slots 2336 are located on top surface 2332 such that slots 2336 are diametrically opposed about top surface 2332. Slots 2336 are adapted to receive dowels 1311 of locking pin 1310.

A pair of seats 2338 are located on diametrically opposing sides of an underside of top surface 2332 as shown. Each seat 2338 is adapted to locate a dowel 1311 of locking pin 1310 when locking assembly 1300 is in the locked position.

Retaining member 2330 further includes a number of angled guide surfaces 2339 on an underside of top surface 2332 with each angled guide surface 2339 extending from a respective slot 2336 to a land 2339A such that each land 2339A is disposed between a respective angled guide surface 2339 and a seat 2338.

As shown each seat 2338 is axially offset from a slot 2336. Preferably, each seat is axially offset by 90 degrees from each slot 2336.

Retaining member 2330 further includes a pair of ramps 2360 each having a guide surface 2361 that extends from within cavity 2334 about an inner face of annular wall 2333 and terminates outwardly of an exterior surface in the form of top surface 2332 as shown.

Guide surface 2361 is adapted to guide a respective dowel 1311 of locking pin 1310 when locking pin 1310 is being removed from excavator wear assembly as will be discussed in greater detail below.

Each ramp 2360 has an abutment face 2362 extending outwardly from top surface 2332 and terminating at guide surface 2361. Furthermore, a locating corner 2363 is located on an underside of each ramp 2360 adjacent a respective seat 2338. Each ramp 2360 also includes an abutment surface 2364 adapted to engage with a surface of biasing member 2320 as will be discussed below.

Figure 13:
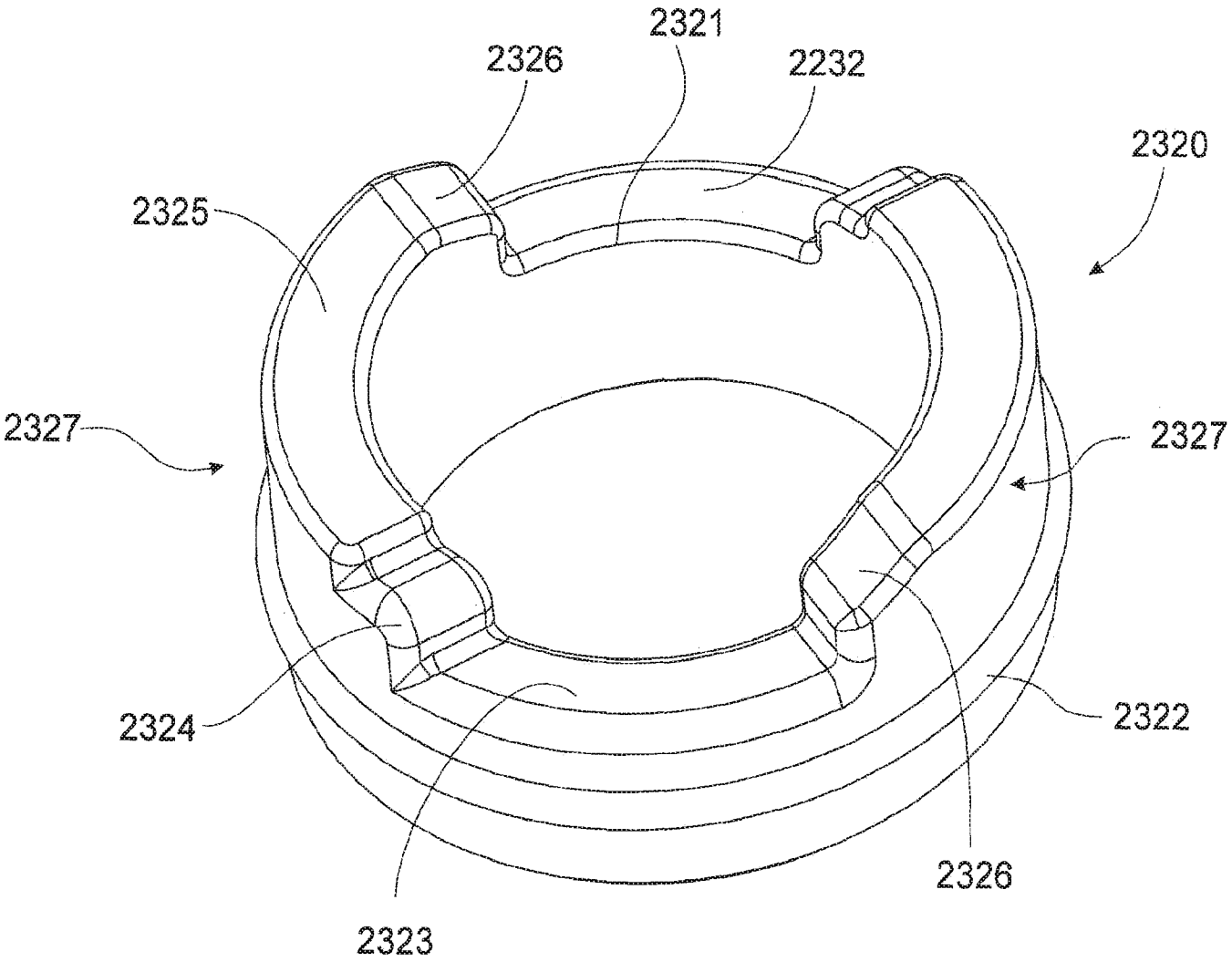
FIG. 13 shows a topside perspective view of a biasing member forming part of the lock assembly shown in FIG. 11A.

FIG. 13 shows a topside perspective view of biasing member 2320 forming part of the lock assembly 2300. Biasing member 2320 is adapted to be located within cavity 2334 of retaining member 2330 as will be discussed in greater detail below.

Biasing member 2320 is generally annular in shape and has an aperture 2321 extending therethrough. Biasing member 2320 is formed from a resiliently deformable plastic or the like and is adapted to be located about main portion 1312 of locking pin 1310.

Biasing member 2320 includes an annular ridge 2322 extending circumferentially about an outer surface thereof. Annular ridge 2322 is adapted to be located within annular valley 2237 of retaining member 2330.

Biasing member 2320 further includes a locating surface 2323 and a pair of abutment portions 2327 extending outwardly from locating surface 2323 as shown. Locating surface 2323 is adapted to oppose and engage abutment surface 2364 of retaining member 2330.

Each abutment portion has a seat 2324, a retaining surface 2325 and a tapered surface 2326. The seat is adapted to be located within a respective locating corner 2363 of retaining member 2330.

Figure 14A:
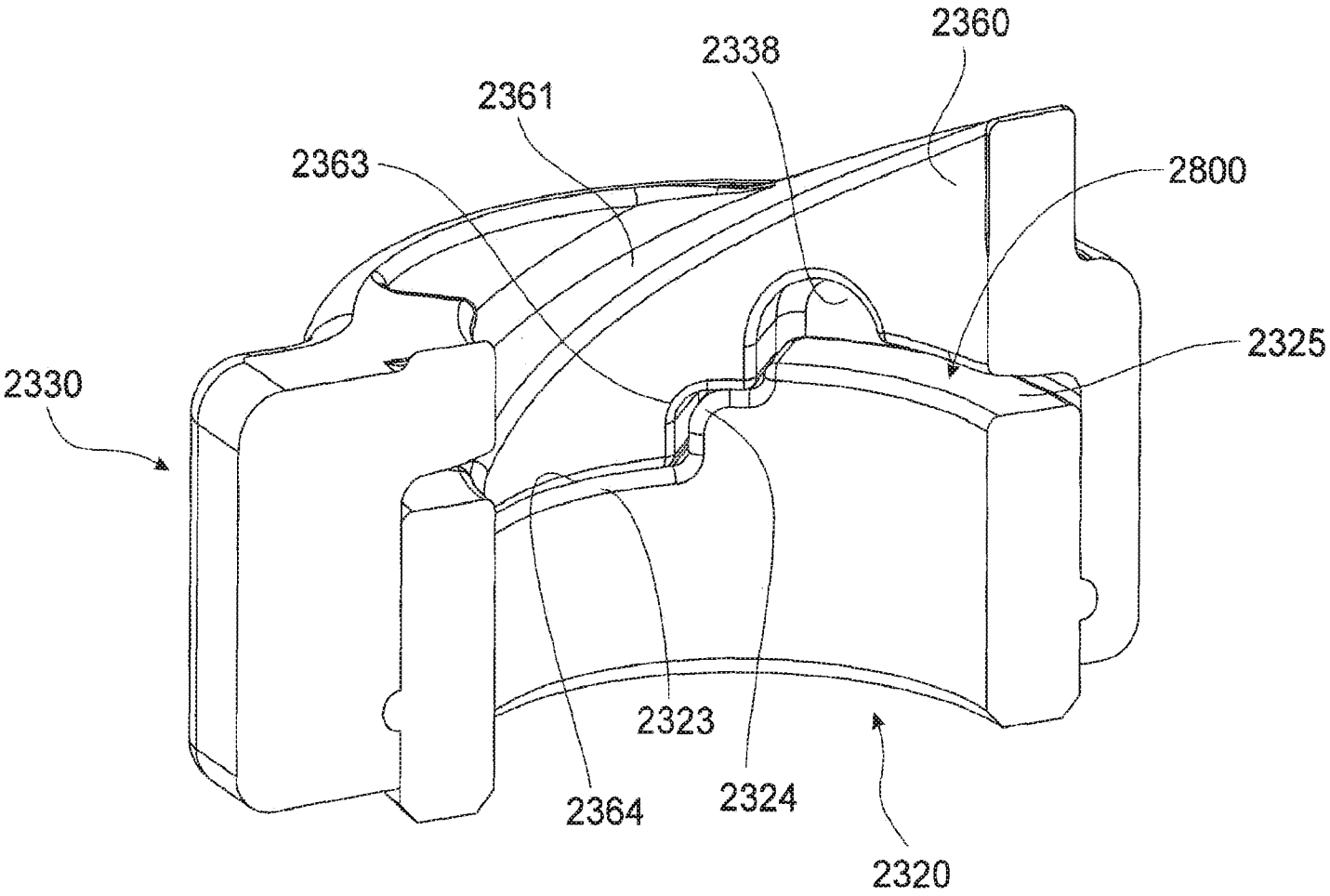
FIG. 14A shows a sectional side view of the retaining member and biasing member forming part of the lock assembly shown in FIG. 11A.
Figure 14B:
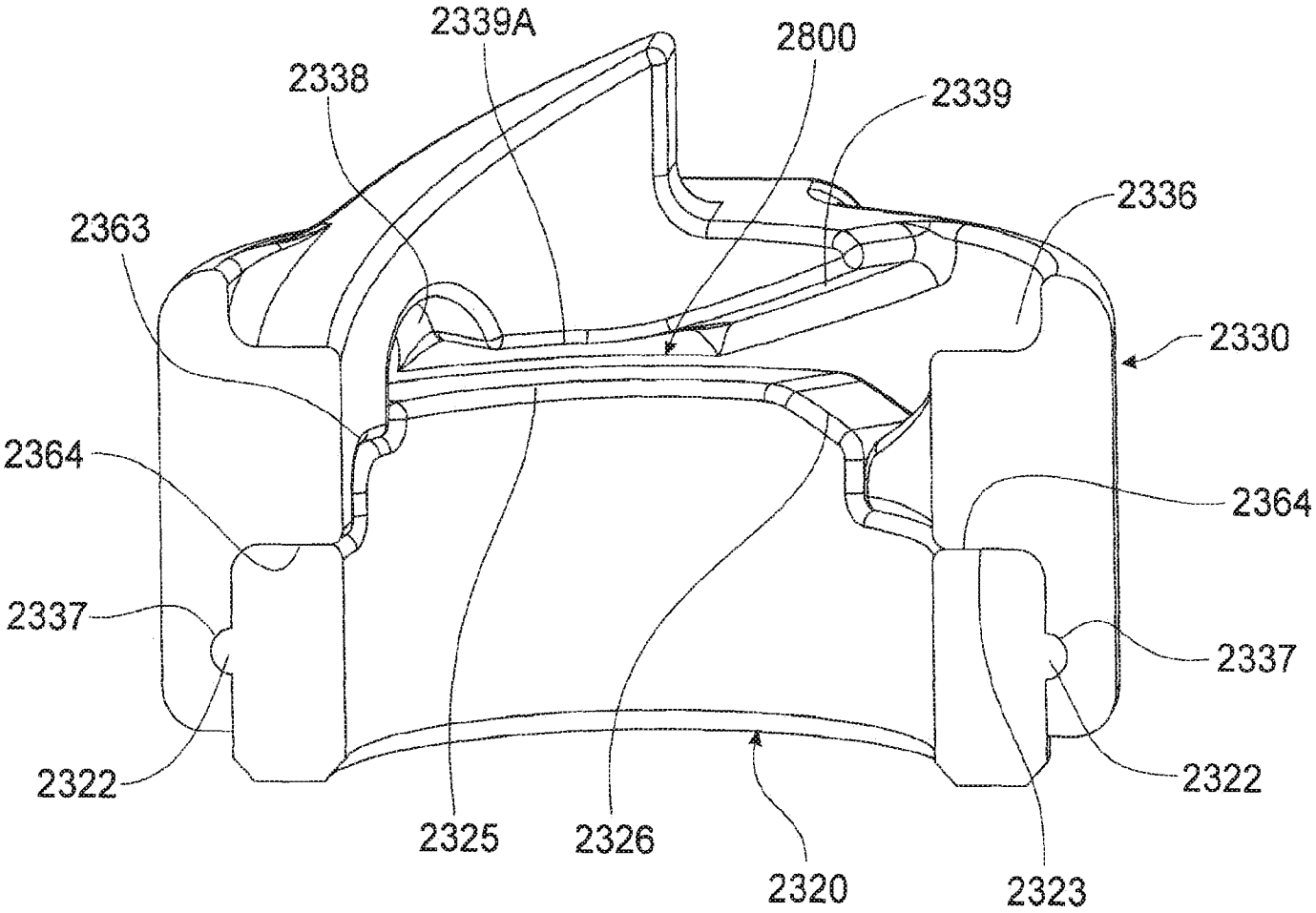
FIG. 14B shows an orthogonal sectional side of the retaining member and biasing member shown in FIG. 14A.

FIG. 14A shows a sectional side view of biasing member 2320 located within aperture 2334 of retaining member 2330 and FIG. 14B shows an orthogonal sectional side view.

As shown, annular ridge 2322 of biasing member 2320 is located within annular valley 2337 of retaining member 2330. Furthermore, each locating surface 2323 opposes and engages abutment surface 2364 of retaining member 2330. In this way, biasing member 1320 is securely located within cavity 1334. Furthermore, each seat 2324 is located within a respective locating corner 2363.

In an optional embodiment, the biasing member 2320 may be permanently secured within cavity 2334 of retaining member 2330 by means of a chemical fastener or the like.

Figure 15A:
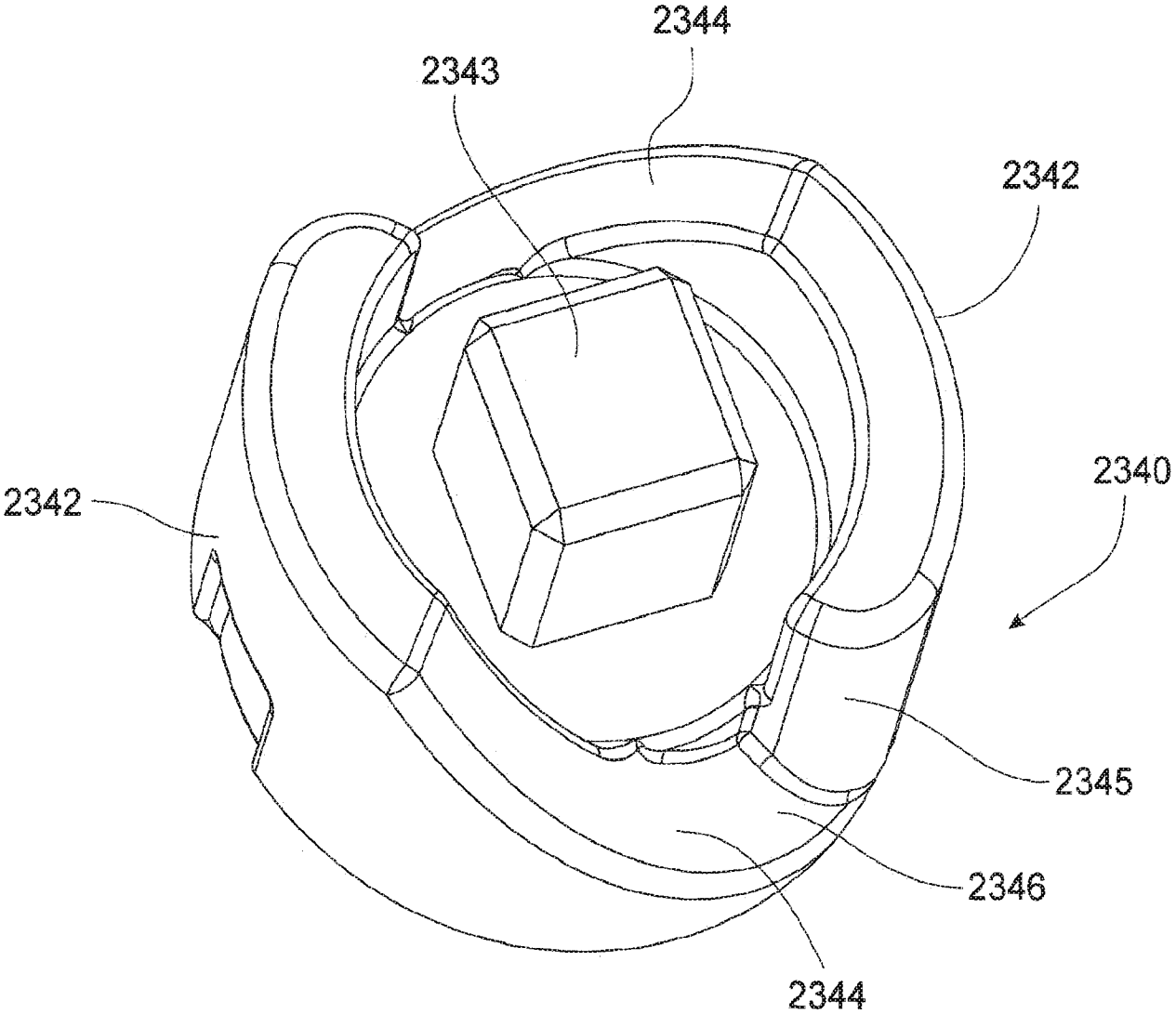
FIG. 15A shows an underside perspective view of a keeper member forming part of the lock assembly shown in FIG. 11A.
Figure 15B:
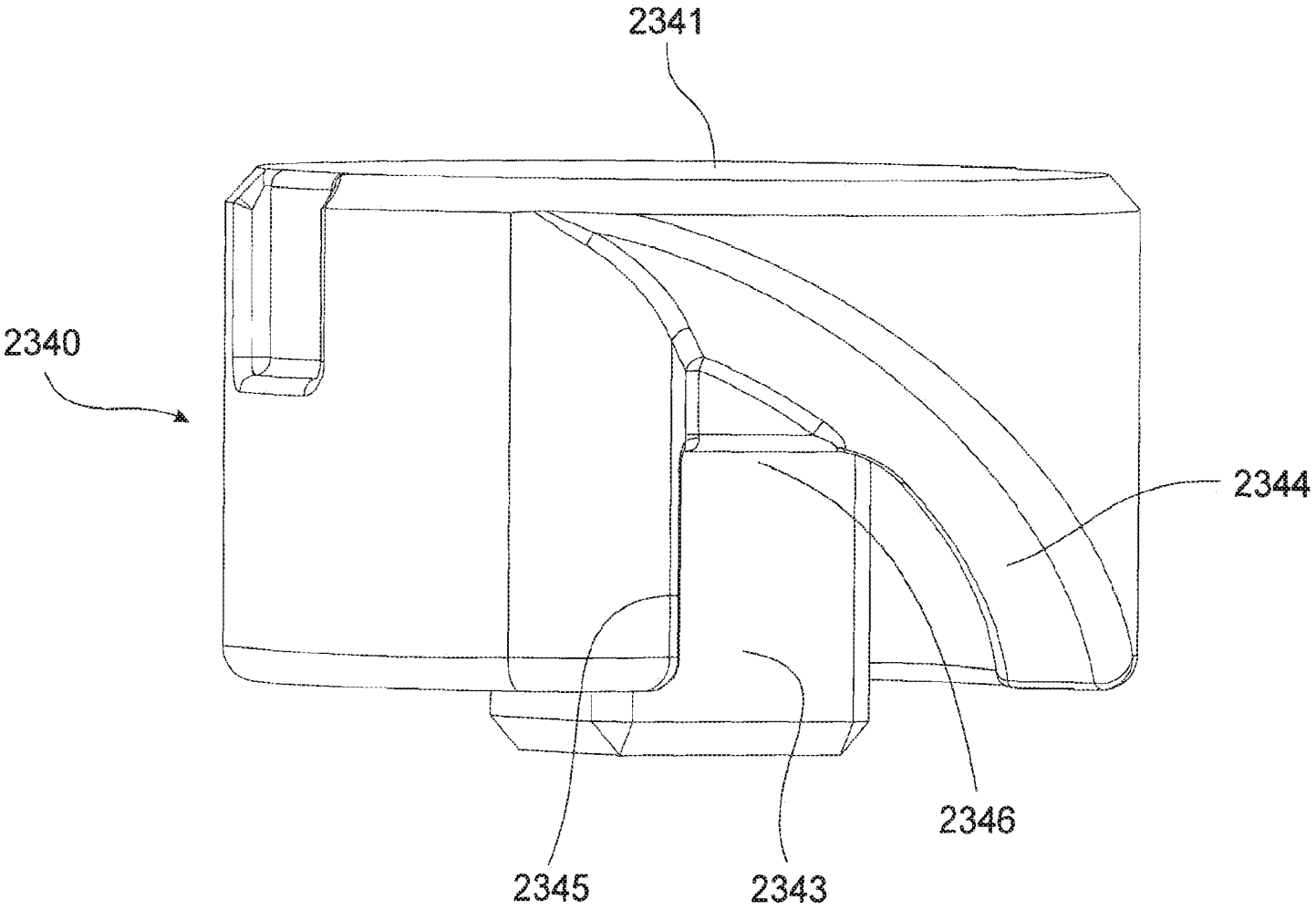
FIG. 15B shows a perspective view of the keeper member shown in FIG. 15A.

FIG. 15A shows an underside perspective view of a keeper member 2340 forming part of lock assembly 2300 and FIG. 15B shows a perspective view of the keeper member 2340.

Keeper 2340 has a generally circular top portion 2341 and a pair of legs 2342 extending from diametrically opposed sides of top portion 2341.

Each leg 2342 has a tapered face 2344 and a locating face 2345 creating a arcuate cutout 2346 between adjacent legs 2342 as shown. Each tapered edge 2344 and each locating edge 2345 are adapted to abut complementary faces located within a locking aperture of a tooth as discussed in greater detail below.

Keeper 2340 further includes a plug 2343 extending from a central region of an underside of top portion 2341. Plug 2343 is adapted to be securely located within recess 1314 of locking pin 1310.

Figure 16A:
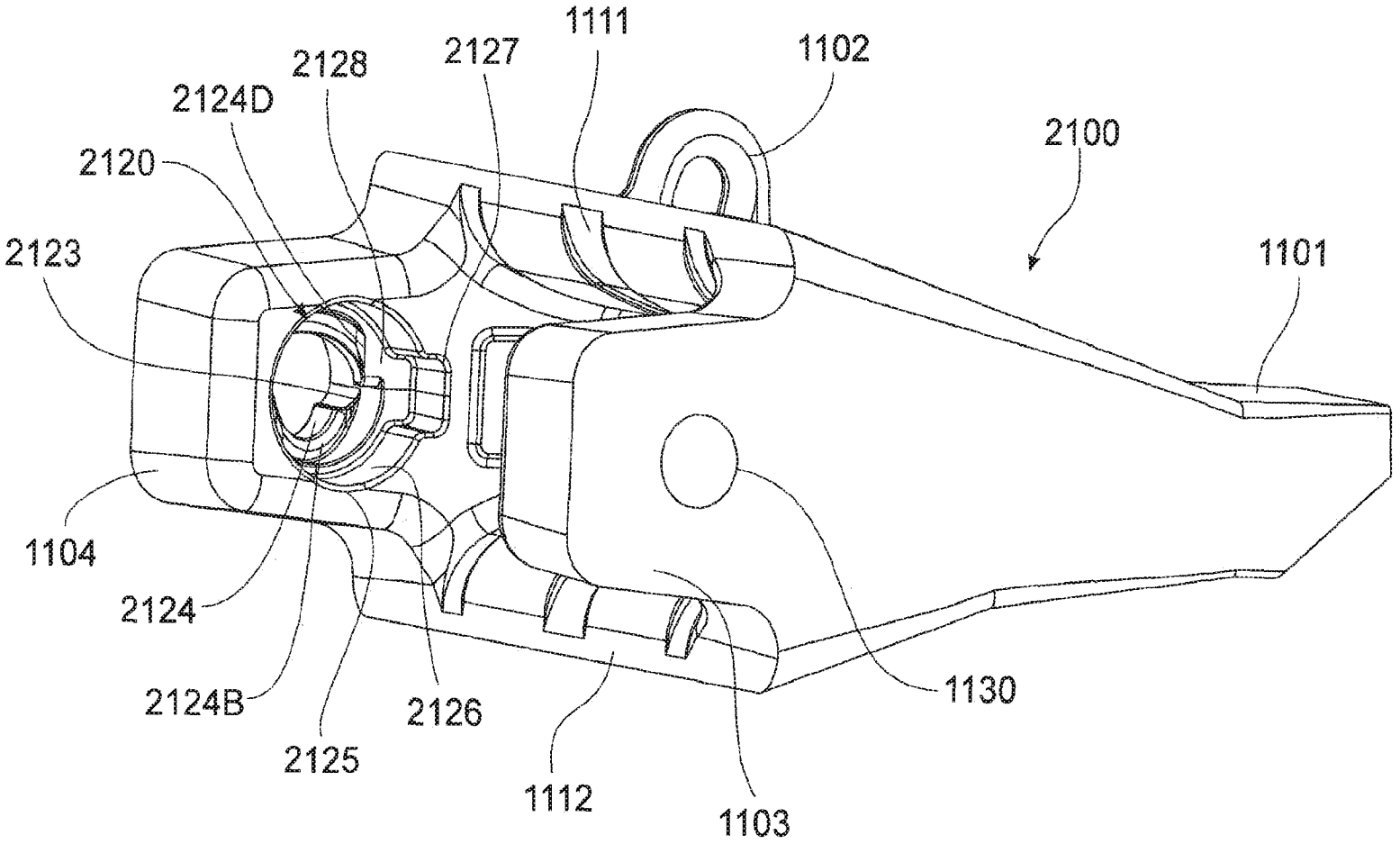
FIG. 16A shows a perspective view of a tooth according to a further embodiment of the invention.
Figure 16B:
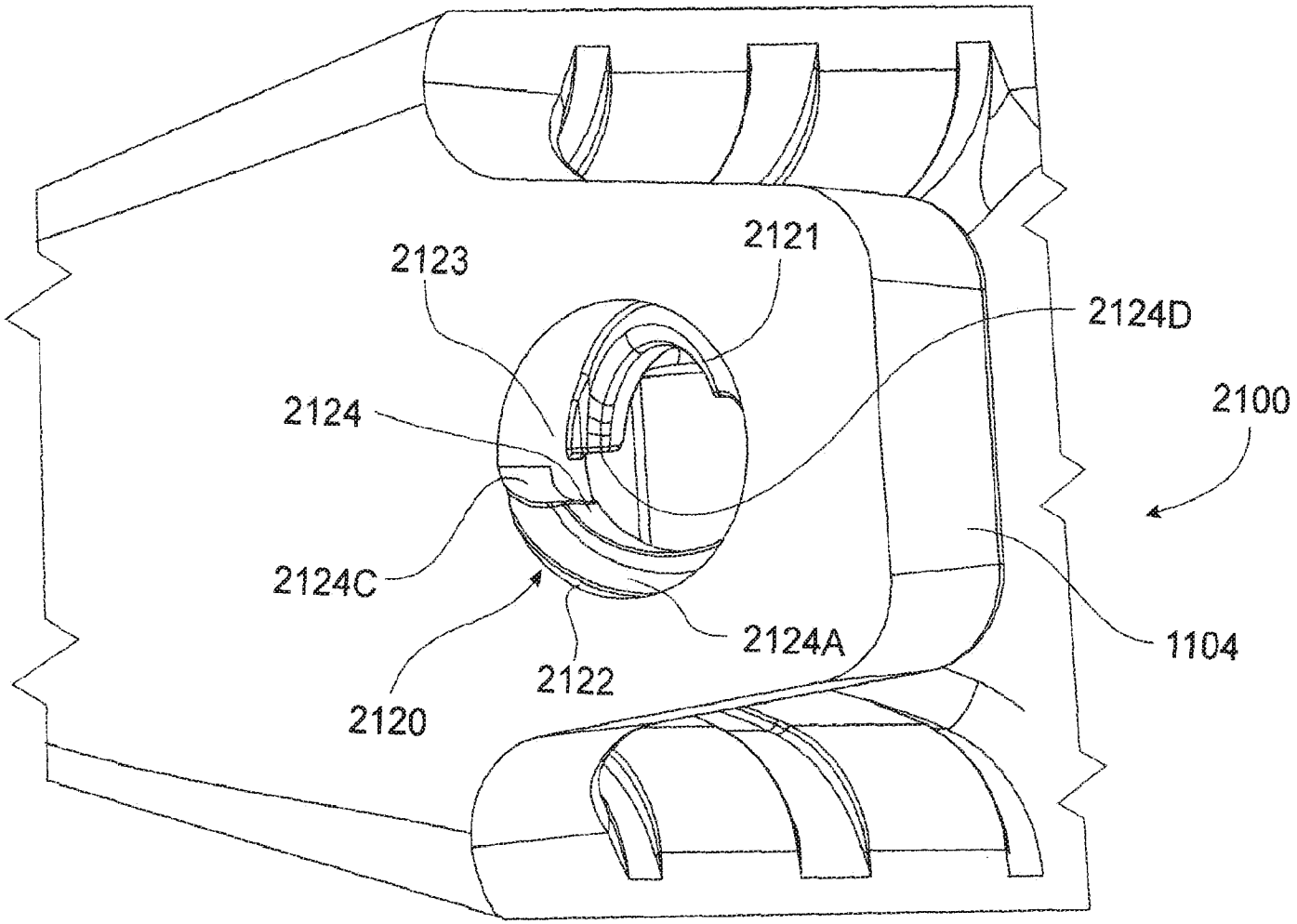
FIG. 16B shows a further perspective view of the tooth shown in FIG. 16A.
Figure 16C:
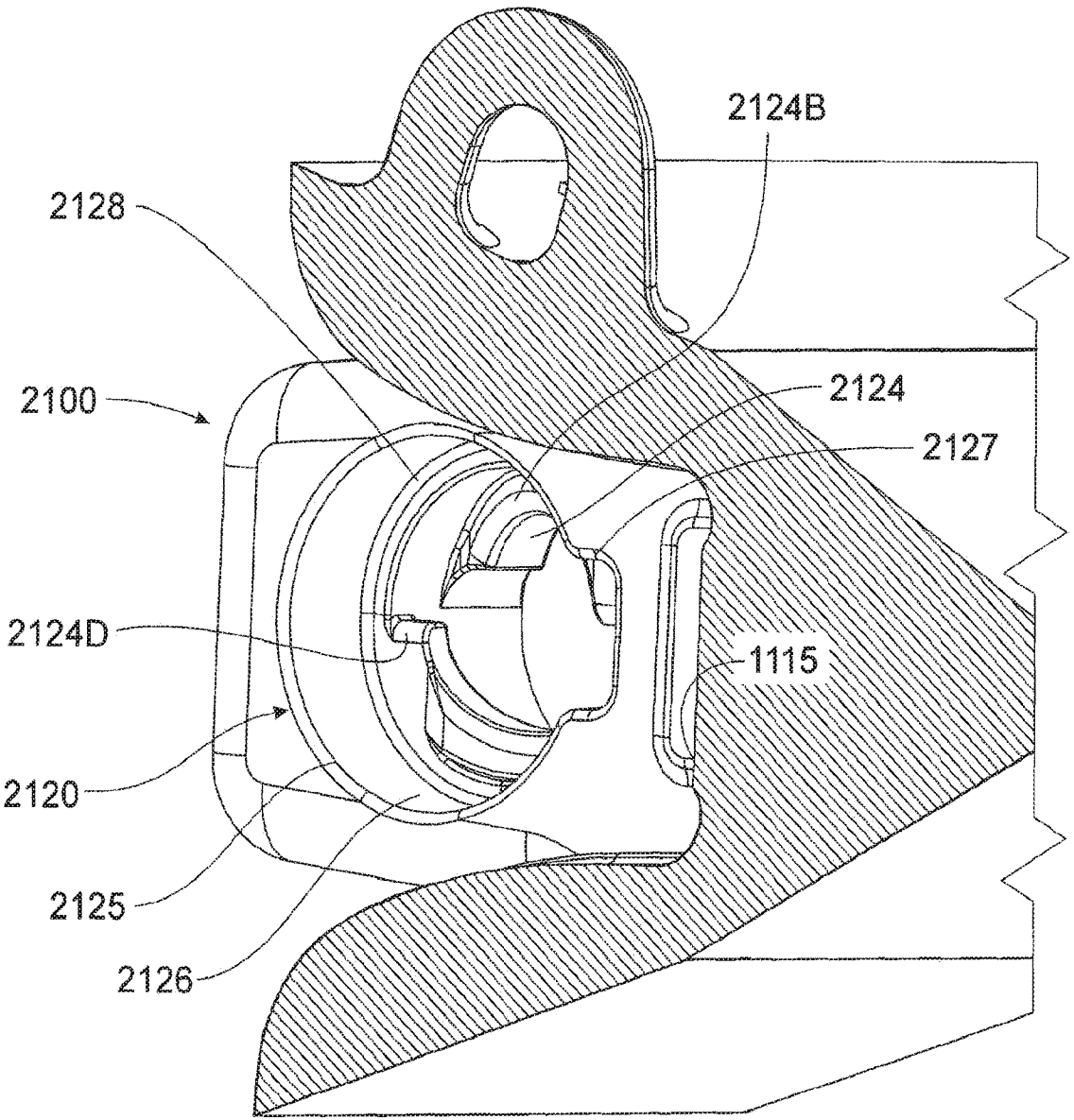
FIG. 16C shows a further perspective view of the tooth shown in FIG. 16A.
Figure 17A:
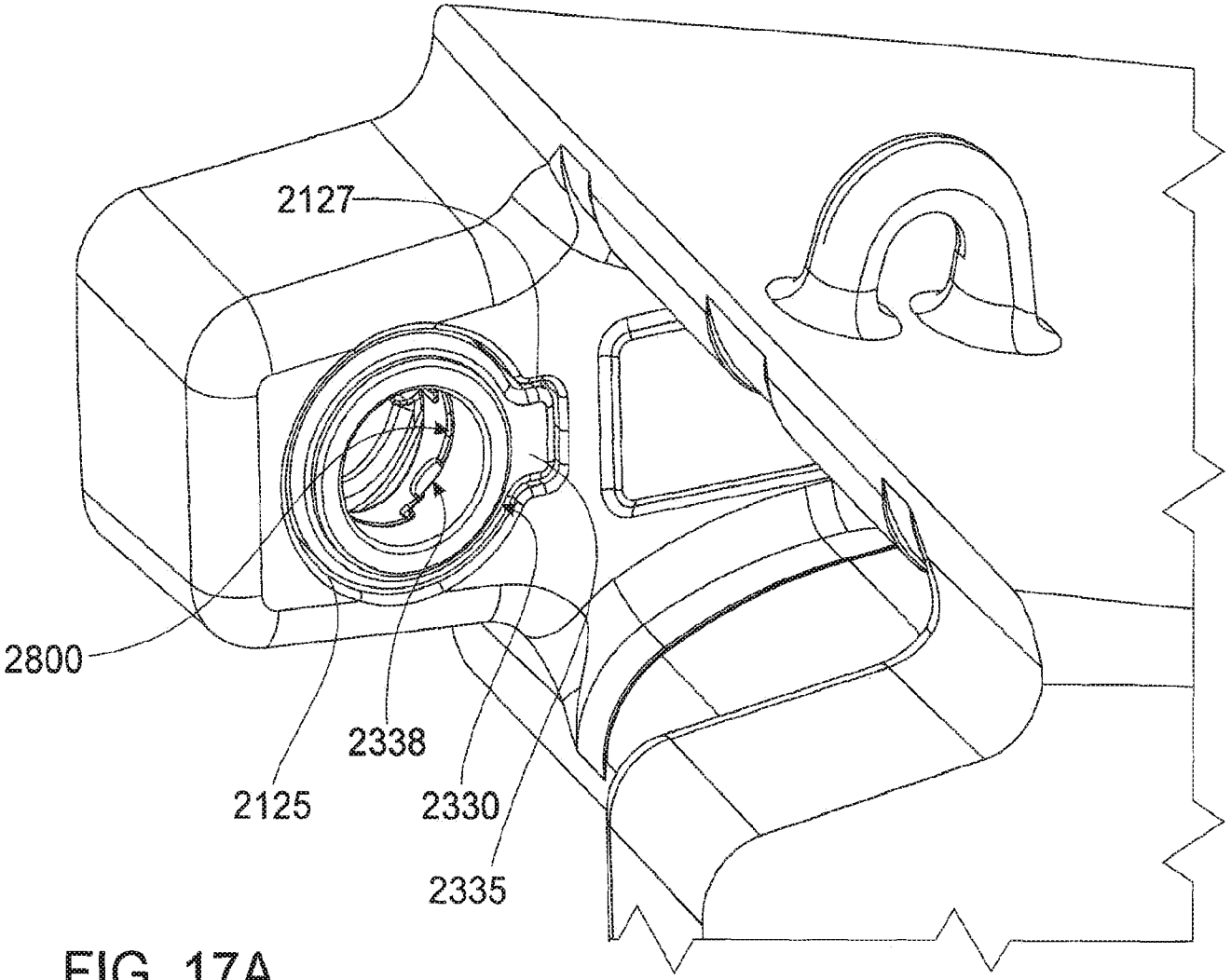
FIG. 17A shows an internal perspective view of components of the locking assembly shown in FIG. 14A located within a tooth.
Figure 17B:
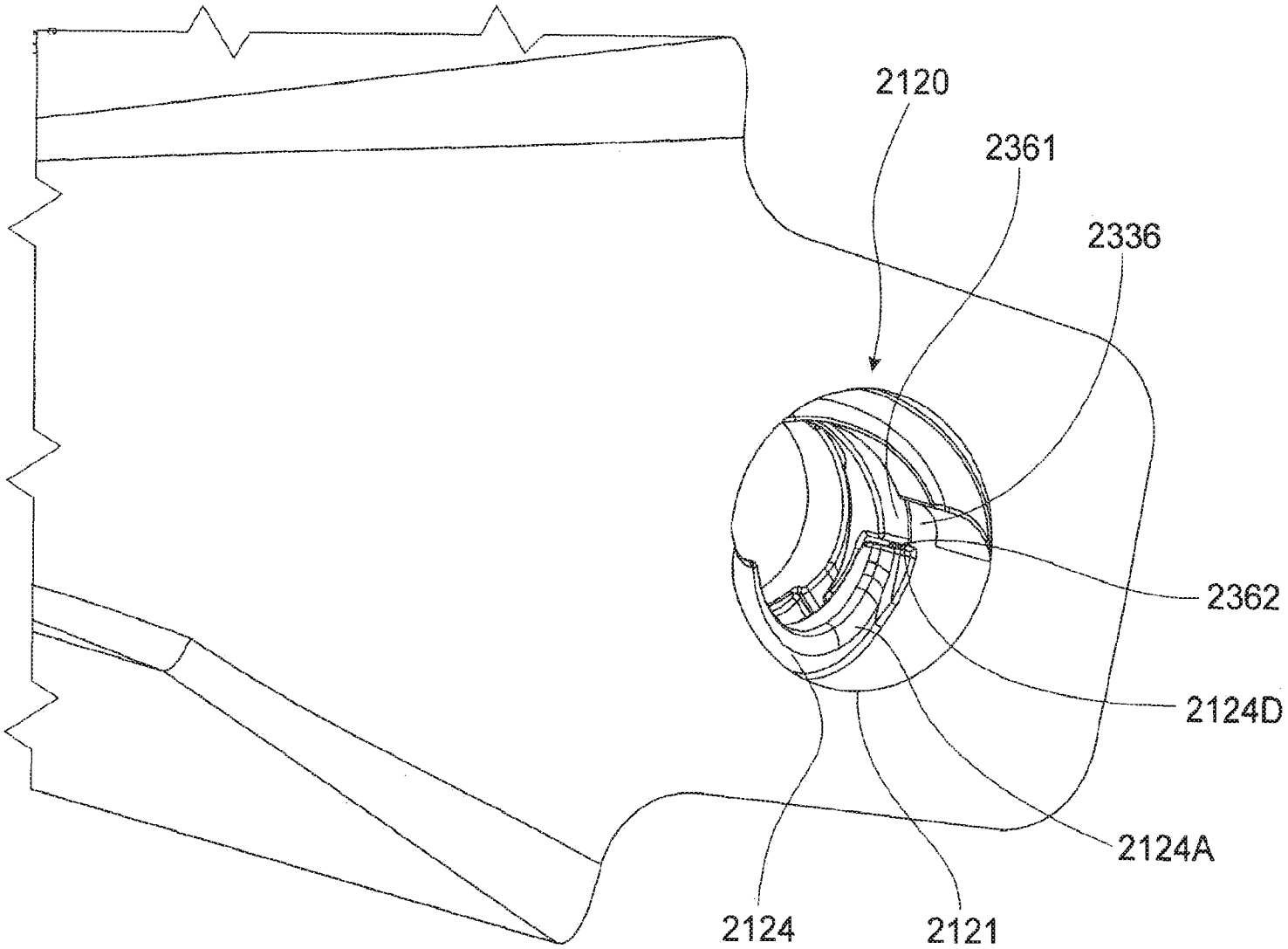
FIG. 17B shows a reverse front perspective view of the components shown in FIG. 17A.
Figure 17C:
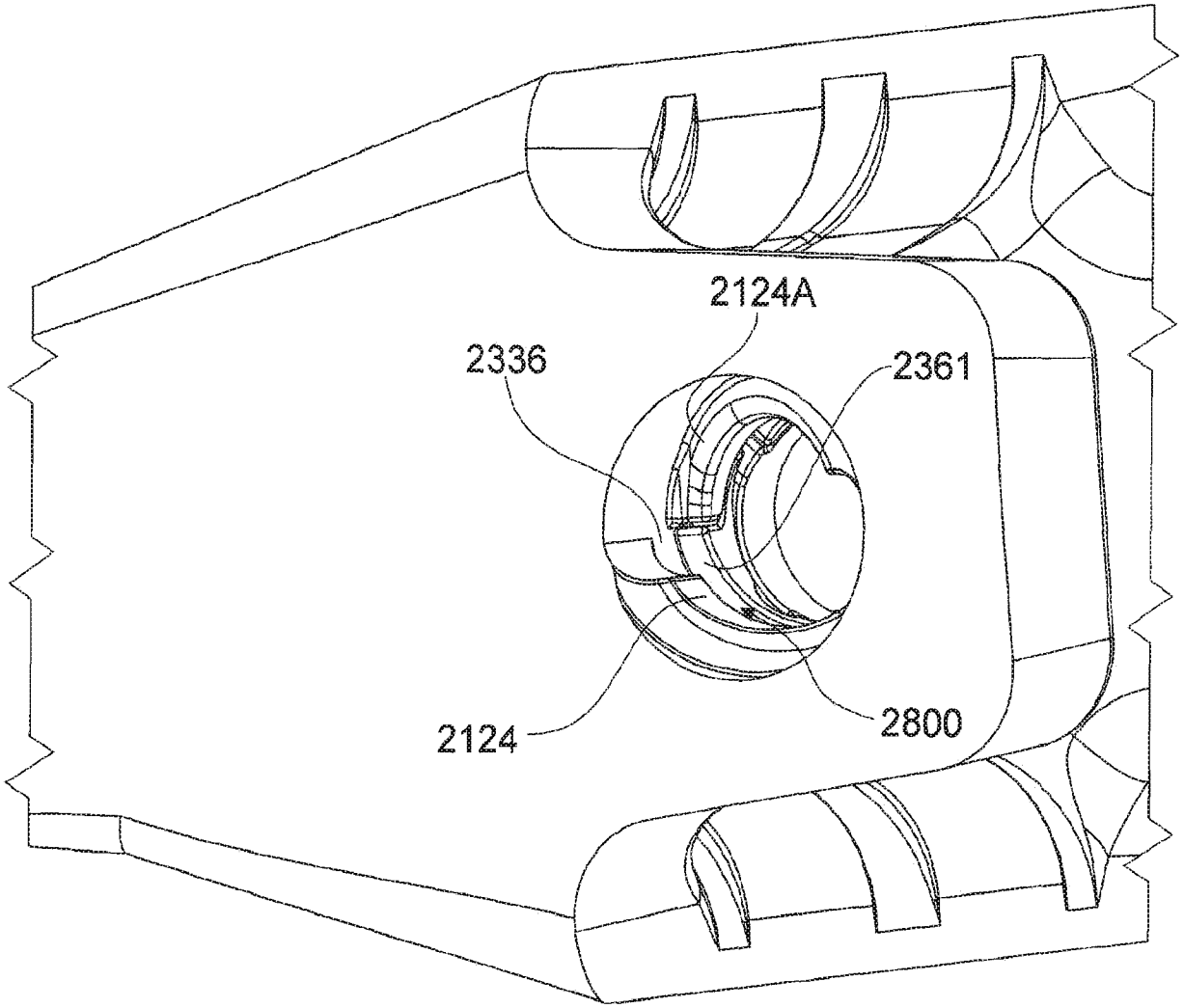
FIG. 17C shows a forward front perspective view of the components shown in FIG. 17A.
Figure 17D:
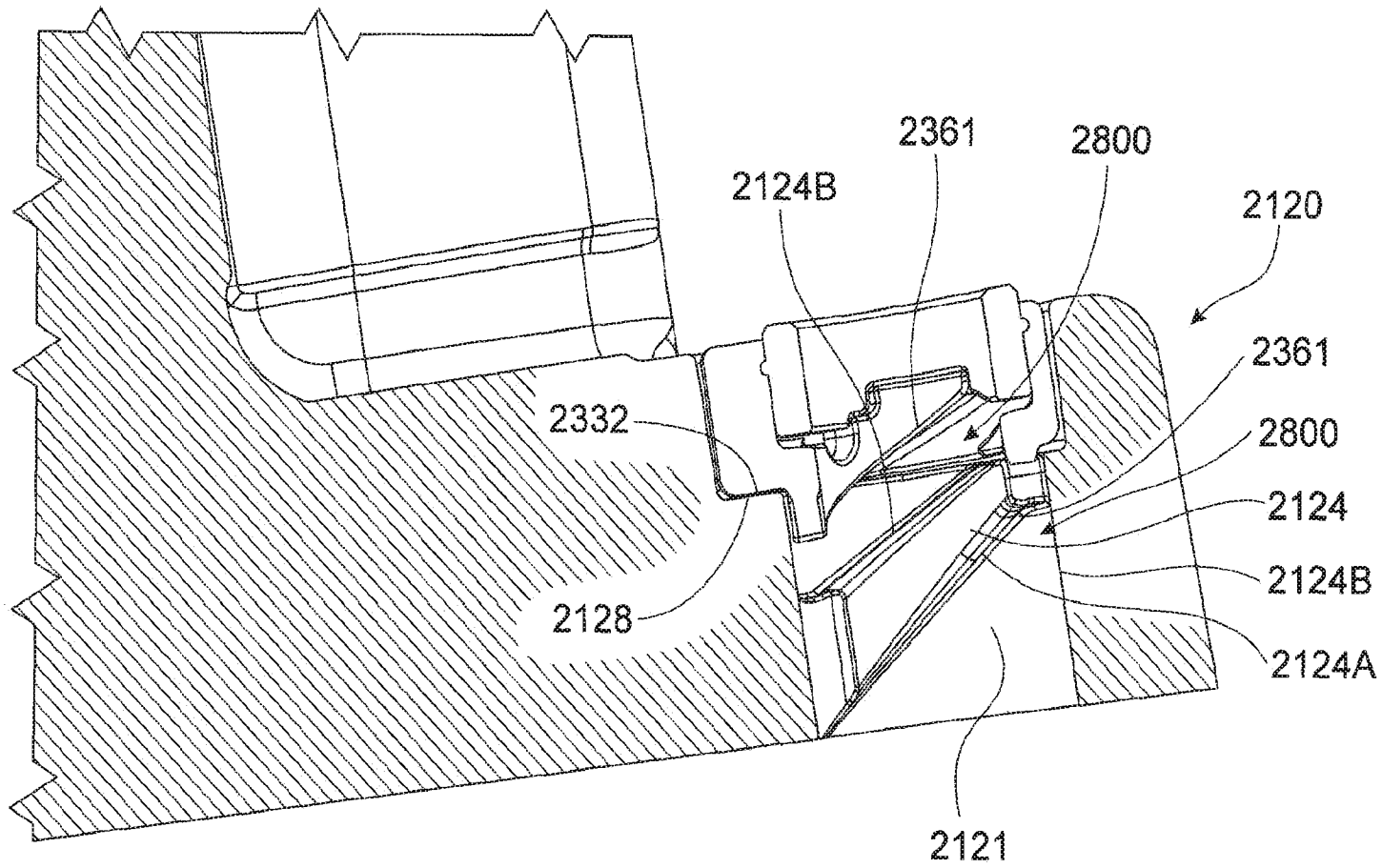
FIG. 17D shows a sectional top view of the components shown in FIG. 17A.

FIG. 16A shows a perspective view of a tooth 2100 according to a further embodiment of the invention. FIG. 16B shows a reverse perspective view of tooth 2100 and FIG. 16C shows a further perspective view of tooth 2100.

As in the previous embodiment, locking aperture 2120 extends through mounting ear 1104 and is formed from a receiving passage 2121 and a retaining recess 2125.

Receiving passage 2121 extends inwardly from an outer face of tooth 2100 and terminates at retaining recess 2125 located on an inner face of mounting ear 1104.

Receiving passage 2121 has a generally circular main portion 2122 and a pair of ramps 2124 extending about an inner face of receiving passage 2121 such that each ramp starts from diametrically opposite sides of receiving passage 2121 adjacent an outer end thereof and traverse a half circumferential path about inner face of receiving passage to terminate adjacent retaining recess 2125.

Each ramp 2124 defines an outwardly facing insertion face 2124A and an inwardly face withdrawal face 2124B.

Slots 2123 are formed on diametrically opposed sides of an inner face of receiving passage 2121 between a head portion 2124C of one ramp 2124 and a tail portion 2124D of the opposed ramp 2124 as shown. Slots 2123 are adapted to receive dowels 1311 of locking pin 1310.

Retaining recess 2125 has a generally circular main portion 2126 and a blind slot 2127 extending outwardly from circular main portion 1126. Circular main portion 2126 of retaining recess 2125 is concentric with circular main portion 2122 of receiving passage 2121 with circular main portion 2126 having a relatively larger diameter thereby forming a locking face 2128 at an inner end of retaining recess 2125.

As in the previous embodiment, lock assembly 2300 is adapted to releasably secure a wear member in the form of tooth 2100 on adaptor 1200.

After locating biasing member 2320 within cavity 2334 of retaining member 2330 as previously discussed, retaining member 2320 is located within retaining recess 2125 of locking aperture 2120 of tooth 2100 as shown in FIG. 17A-FIG. 17D.

As shown, in this position detent 2335 is located within blind slot 2127 thereby non-rotatably locating retaining member 2330 within retaining recess 2125.

Furthermore, top surface 2332 of retaining member 2330 abuts locking face 2128 as shown.

Abutment face 2362 of each ramp 2360 of retaining member 2330 engages a face of toe portion 2124D of a respective ramp 2124 in receiving passage 2121 thereby aligning each guide surface 2361 of retaining member 2330 with a respective outwardly facing insertion face 2124A of each ramp 2124 as shown.

In this arrangement, twin helical slots 2800 are formed to enable passage within a helical slot 2800 of a respective dowel 1311 of locking pin 1310 to a respective seat 2338 of retaining member 2330 as will be discussed in greater detail below.

Each helical slot 2800 is formed by the passage between guide surface 2361 and withdrawal face 2124B of a respective ramp 2124. The helical slot 2800 then extends to slot 2336 of retaining member 2330, continues between retaining surface 2325 of biasing member 2320 and angled guide surface 2339 of retaining member 2330, traverses between retaining surface 2325 of biasing member 2320 and land 2339A of retaining member 2330 before terminating at seat 2338 of retaining member 2330.

In an optional embodiment, retaining member 2330 may be permanently secured within retaining recess of locking aperture 2120 of tooth 2100 by means of a chemical fastener or the like such that tooth 2100 is provided in the arrangement as shown in FIGS. 17A-17D. Alternatively, retaining member 2330 alone may be integrally formed with tooth 2100.

Figure 18A:
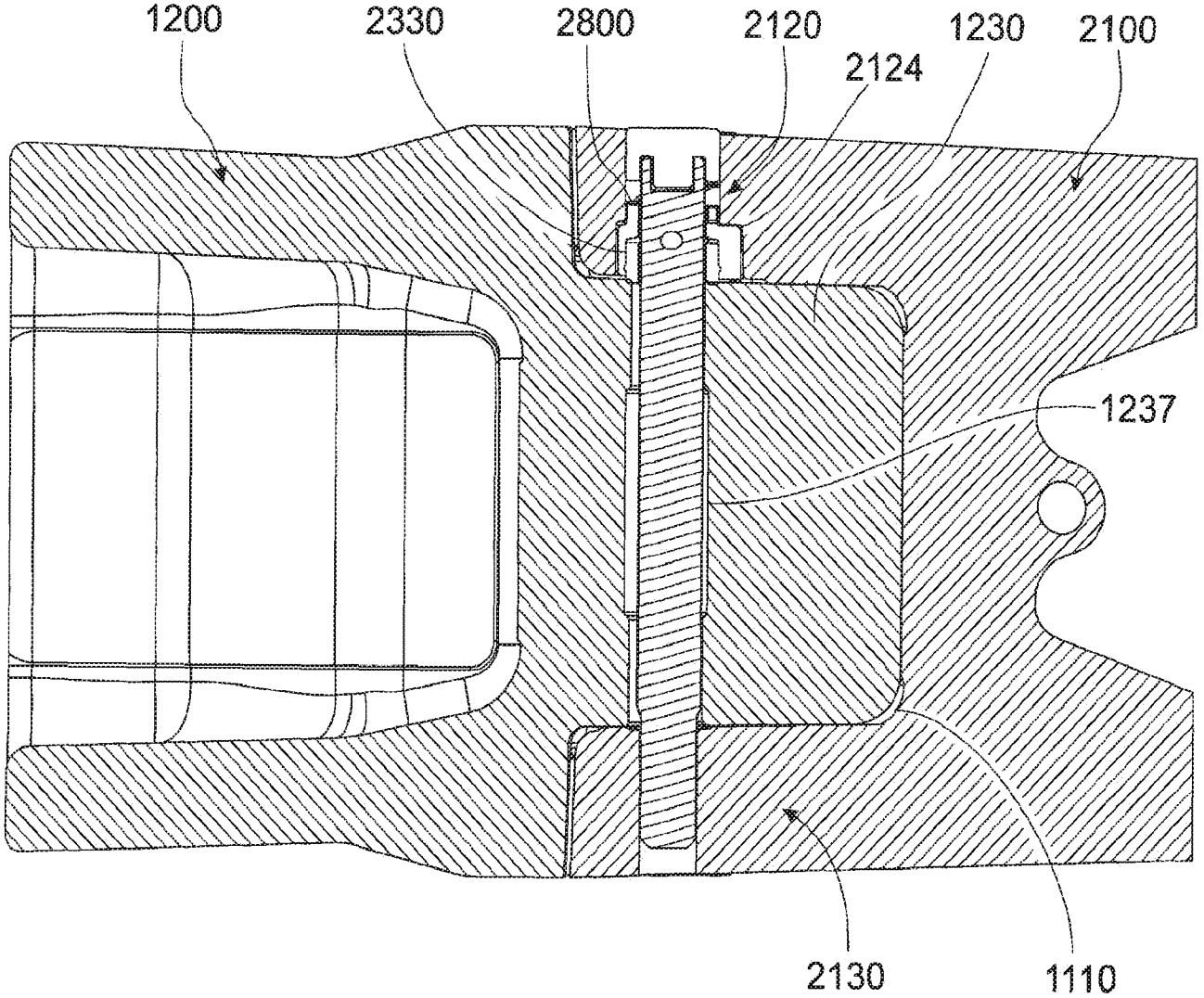
FIG. 18A shows a sectional top view of the lock assembly in the locked position with a keeper associated therewith.

The tooth 2100 is then slidably mounted onto adaptor 1200 such that spigot portion 1230 is located within socket cavity 1110 of tooth 1100 as previously discussed and locking pin 1310 of lock assembly 2300 is then located through at least partially aligned locking aperture 2120, retaining passage 1237 and toe aperture 2130, as shown in FIG. 18A, in order to place the lock assembly 1300 in the locked position to releasably retain tooth 2100 on adaptor 1200.

In this position, the retaining member 2330 is captively retained in retaining recess 2124 of tooth 2100 in view of retaining recess 2124 being coaxial with retaining passage 1237 of adaptor 1200 as previously discussed.

In order to move the lock assembly 2300 to a locked position thereby releasably securing 2100 on adaptor 1220, toe portion 1313 of locking pin 1310 is first located through locking aperture 2120 of tooth 2100. Toe portion 1313 travels through receiving passage 2121 of locking aperture 2120, aligned aperture 2332A of retaining member and aperture 2321 of biasing member 2320 and into retaining passage 1237 of spigot portion 1230 of adaptor 1200.

Dowels 1311 traverse within helical slots 2800 commencing travel from the portion of a respective helical slot 2800 formed by opposing faces of the guide surface 2361 of ramp 2360 and the withdrawal face 2124B of a respective ramp 2124.

The travel of each dowel 1311 within a respective helical slot 2800 causes locking pin 1310 to locate within the aligned apertures and also urges rotation of the locking pin 1310 about a longitudinal axis thereof.

This translation continues until a face of each dowel 1311 contacts retaining surface 2325 of biasing member 2320. At this stage of insertion, toe portion 1313 is located within toe aperture 2130 of tooth 2100 as shown.

In order to completely translate lock assembly 2300 to the locked position as shown in FIG. 18A, locking pin 1310 is rotated axially about a longitudinal axis thereof in order to move each dowel 1311 into a respective seat 2338 of retaining member 2300.

Each dowel 1311 has a diameter that is greater in length than a width of helical slot 2800 formed at that point between retaining surface 2325 and an inner surface of land 1339A. As such, as locking pin 1310 is axially rotated, a face of each dowel 1311 is urged into abutment with a face of a respective angled guide surface 2339 whilst an opposing face of each dowel 1311 remains in contact with retaining surface 2325.

As previously discussed, biasing member 2320 is formed from a resiliently deformable material such that as the locking pin 1310 is axially rotated and each dowel 1311 travels against a respective angled guide surface 2339, biasing member 2320 is thereby compressed.

When a face of each dowel 1311 bears against a face of a respective land 2339A, biasing member 2320 is at full compression. As the locking pin 1310 continues to be axially rotated, a face of each dowel 1311 is urged by the compressive force of biasing member 2320 into a respective seat 2338.

Suitably, a power tool is used to axially rotate locking pin 1310 and urge each dowel 1311 to traverse a respective helical slot 2800 such that a sufficient force is used to overcome the biasing force of biasing member 2320.

In this position, a face of each dowel 1311 is held in firm abutment with a face of seat 2338 by the biasing force supplied by biasing member 2320 in order to captively retain locking pin 1310 within partially aligned locking aperture 2120, retaining passage 1237 and toe aperture 2130 as shown. As such, wear member in the form of tooth 2100 is releasably secured to adaptor 1200 by lock assembly 2300.

Figure 18B:
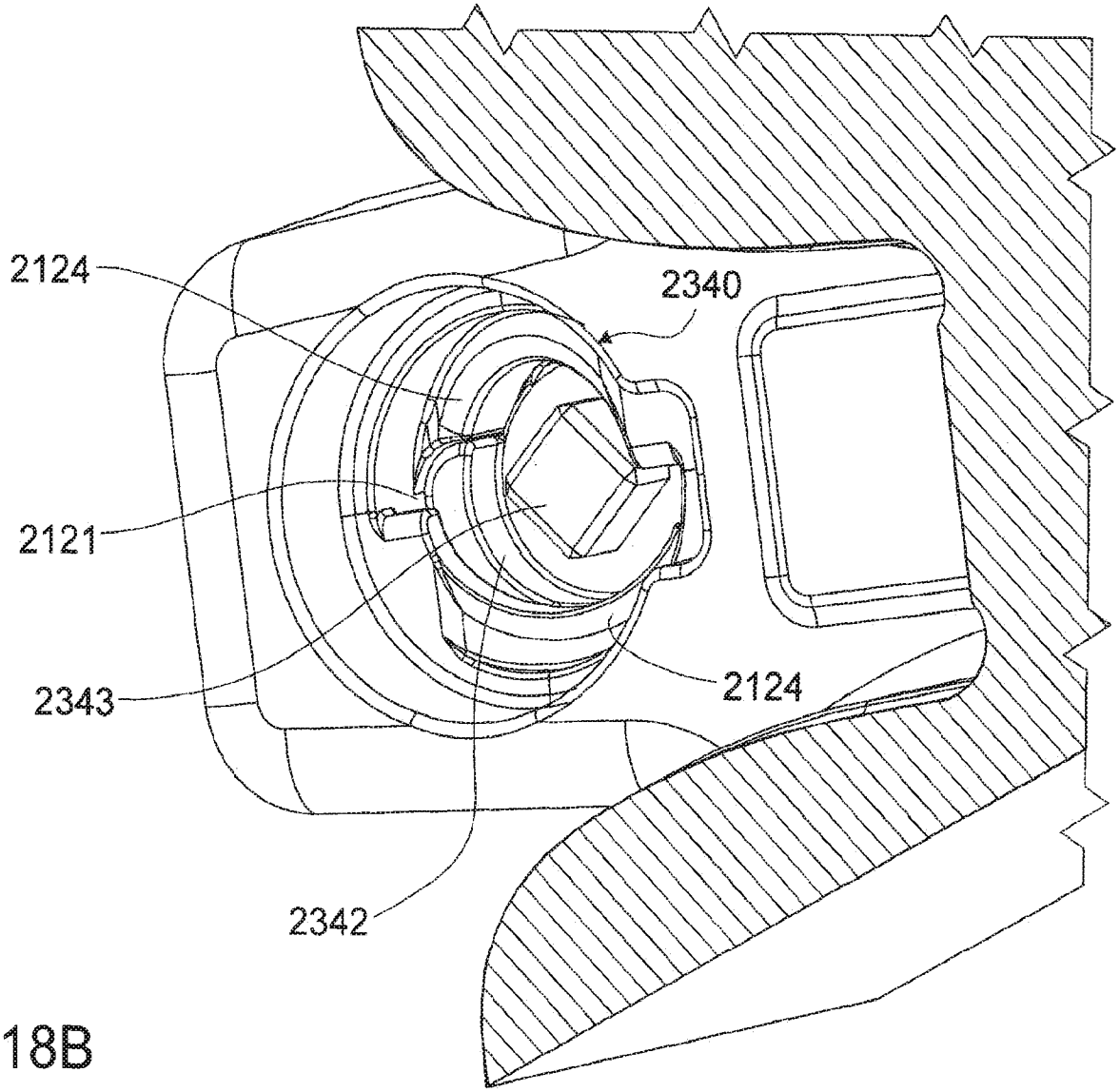
FIG. 18B shows an internal perspective view of the keep shown in FIG. 18A.

Keeper 2340 is then located within locking aperture 1120 as shown in FIG. 18B. Plug 2343 is located within recess 1314 by way of an interference fit in order that keeper 2340 is secured to locking pin 1310. Furthermore, legs 2342 extend between the ramps 2124 of receiving passage 2121.

Keeper 2340 prevents ingress of fines and the like into locking aperture 2120.

The embodiment of the locking pin 2300 and tooth 2100 discussed above has particular advantages when it is time to replace tooth 2100 due to wear.

The keeper member 2340 is first removed. A power tool is then used to axially rotate locking pin 1310 and urge each dowel 1311 to traverse a respective helical slot 2800 out from a respective seat 2800 against the biasing force of biasing member 2320. Each dowel 1311 travels along a respective helical slot 2800 and that translation urges locking pin 1310 to begin to eject outwardly of locking aperture 2120.

An outward end of locking pin 1310 is then available in order to draw the locking pin entirely from the aligned apertures and thus remove tooth 2100 from adaptor 1200.

The ejection of locking pin 1310 from locking aperture 2120 as a consequence of a power tool axially rotating locking pin 1310 as described above is particularly advantageous in circumstances where the locking pin 1310 becomes cemented within retaining passage 1237 of spigot portion 1230 of adaptor 1200 through ingress of fines and moisture. The powered axial rotation is sufficient to overcome the force of the cementation and partially eject the pin 1310 to provide purchase for further withdrawal.

The excavator wear assembly of the invention and the lock assembly for securing the wear member in the form of a tooth to an adaptor avoids the need for threaded components and complex parts. Furthermore, the lock assembly avoids the need for heavy hammers and the like for mounting within the respective retaining apertures and retaining cavities. In this way, the invention provides for an effective method of releasably securing the tooth to the adaptor.

Throughout the specification the aim has been to describe the invention without limiting the invention to any one embodiment or specific collection of features. Persons skilled in the relevant art may realize variations from the specific embodiments that will nonetheless fall within the scope of the invention.

It will be appreciated that various other changes and modifications may be made to the embodiment described without departing from the spirit and scope of the invention.

In this specification, where different embodiments share identical features, common reference numbers are used to identify those identical features.

The invention claimed is:

1. An excavator wear member comprising:

a body;

a side wall having a mounting ear extending rearwardly of the body;

a socket cavity extending into the body and at least partially defined by the side wall, an upper wall and a lower wall;

a locking aperture extending through the side wall of the excavator wear member, the locking aperture having a receiving passage and a retaining recess, the retaining recess having a generally circular main portion and a blind slot extending outwardly of the main portion, the retaining recess being larger in cross sectional area, taken transversely to an axis extending through the locking aperture, relative to the receiving passage;

wherein, the receiving passage extends inwardly from an outer face of the side wall and the retaining recess is located on an inner face of the side wall such that the receiving passage terminates at the retaining recess, and wherein a planar locking face is located at an end of the retaining recess proximal the receiving passage, the planar locking face extending from one side of the receiving passage to an opposite side of the receiving passage.

2. An excavator wear member as claimed in claim 1, wherein at least part of the locking aperture extends through the mounting ear.

3. An excavator wear member as claimed in claim 1, wherein the socket cavity includes a rib on a surface thereof.

4. An excavator wear member as claimed in claim 3, wherein the rib is located forward of the locking aperture towards a front end of the body.

5. An excavator wear member as claimed in claim 4, wherein the rib is located along a sidewall of the socket cavity adjacent to the locking aperture.

6. An excavator wear member as claimed in claim 1, wherein a pair of slots extend outwardly from diametrically opposed sides of the receiving passage.

7. An excavator wear member as claimed in claim 1, wherein a ramp extends about an inner face of receiving passage.

8. An excavator wear member as claimed in claim 7, wherein the ramp commences adjacent an outer end of the receiving passage and extends circumferentially about an inner face of receiving passage to terminate adjacent the retaining recess.

9. An excavator wear member as claimed in claim 1, wherein two ramps extend about an inner face of the receiving passage from diametrically opposing sides thereof.

10. An excavator wear member as claimed in claim 1, wherein the receiving passage has a generally circular main portion, wherein the generally circular main portion of the receiving passage is concentric with the generally circular main portion of the retaining recess.

11. An excavator wear member as claimed in claim 10, wherein the generally circular main portion of the retaining recess has a larger diameter than the generally circular main portion of the receiving passage.

12. An excavator wear member as claimed in claim 1, wherein the socket cavity has an upper rear bearing surface and a lower rear bearing surface converging towards a front bearing face of the socket cavity.

13. An excavator wear member as claimed in claim 12, wherein the socket cavity further comprises an upper forward bearing surface and a lower forward bearing surface that are substantially parallel to one another.

14. An excavator wear member as claimed in claim 13, wherein the front bearing face is disposed between the upper forward bearing surface and the lower forward bearing surface.

15. An excavator wear member as claimed in claim 1, wherein the cross-sectional area of the retaining recess and the receiving passage is taken transversely to a longitudinal axis extending through the locking aperture.

* * * * *